US011629941B2

(12) United States Patent
Makarov et al.

(10) Patent No.: US 11,629,941 B2
(45) Date of Patent: Apr. 18, 2023

(54) CASELESS AMMUNITION FOR FIREARM AND THE MECHANISM FOR THE EXTRACTION OF CASELESS AMMUNITION

(71) Applicants: Georgii Georgiiovych Makarov, m. Kyiv (UA); Hlib Georgiiovych Makarov, m. Kyiv (UA); Kostiantyn Okrevych Trypolskyi, m. Kyiv (UA); Serhii Anatoliiovych Babenko, m. Dnipro (UA); Sergii Pavlovych Zibrov, m. Kyiv (UA); Oleksii Oleksandrovych Sharkov, m. Kyiv (UA)

(72) Inventors: Georgii Georgiiovych Makarov, m. Kyiv (UA); Hlib Georgiiovych Makarov, m. Kyiv (UA); Kostiantyn Okrevych Trypolskyi, m. Kyiv (UA); Serhii Anatoliiovych Babenko, m. Dnipro (UA); Sergii Pavlovych Zibrov, m. Kyiv (UA); Oleksii Oleksandrovych Sharkov, m. Kyiv (UA)

( * ) Notice: Subject to any disclaimer, the term of this patent is extended or adjusted under 35 U.S.C. 154(b) by 0 days.

(21) Appl. No.: 17/465,992

(22) Filed: Sep. 3, 2021

(65) Prior Publication Data

US 2022/0113122 A1 Apr. 14, 2022

Related U.S. Application Data

(62) Division of application No. 16/613,636, filed as application No. PCT/UA2017/000062 on Jun. 6, 2017, now Pat. No. 11,204,225.

(30) Foreign Application Priority Data

May 15, 2017 (UA) ..... a 2017 04665

(51) Int. Cl.
*F41A 15/20* (2006.01)
*F42B 5/18* (2006.01)
*F41A 15/16* (2006.01)

(52) U.S. Cl.
CPC ..... *F42B 5/18* (2013.01); *F41A 15/16* (2013.01); *F41A 15/20* (2013.01)

(58) Field of Classification Search
CPC .. F42B 5/18; F42B 5/181; F42B 5/182; F42B 5/184; F42B 5/188; F42B 5/192;
(Continued)

(56) References Cited

U.S. PATENT DOCUMENTS 17,287 A * 5/1857 Lindner ..... F42B 5/18 102/431
35,949 A * 7/1862 Potter ..... F42B 5/18 102/431
(Continued)

FOREIGN PATENT DOCUMENTS

BY 6256 C1 6/2004
RU 2113686 C1 6/1998
(Continued)

*Primary Examiner* — Joshua E Freeman

(57) ABSTRACT

A mechanism for extraction caseless ammunition, the mechanism for extraction including a receiver (84) interacting with the lid of the receiver (85); lock frame (86) which interacts with the lid of the receiver; bolt (88) made in the lock frame; a conical bushing (93) installed inside the bolt through the firing pin (89); an extractor (95), wherein lock frame is made with a front ledge (87); on the front end of the firing pin the conical part (90) is made; conical bushing (93) is made with interior ledges (94); a shaft (103) with a circular groove (104); the rear part (102) passes into the lower ledge (106) which has a front inclined area (107) and a rear horizontal area (108) and the lower ledge (106) passes
(Continued)

into the upper ledge (109) which has a front inclined area (110), an upper horizontal area (111) and a rear inclined area (112).

7 Claims, 33 Drawing Sheets

(58) Field of Classification Search
CPC ..... F41A 15/00; F41A 15/12; F41A 15/16; F41A 15/20; F41A 15/22
See application file for complete search history.

(56) References Cited

U.S. PATENT DOCUMENTS 39,915 A * 9/1863 Hall ..... F42B 5/18 102/431
109,931 A * 12/1870 Page ..... F42B 5/18 102/431
695,809 A * 3/1902 Hawk ..... F42B 5/18 102/431
2,411,979 A * 12/1946 Rataiczak ..... F41A 15/16 42/25
3,096,715 A * 7/1963 Dufour ..... F42B 14/02 102/518
3,435,765 A * 4/1969 Gawlick ..... F42B 5/18 102/466
3,439,635 A * 4/1969 Hensley ..... F42B 5/184 102/700
3,463,086 A * 8/1969 Silva ..... F42C 19/085 102/431
3,482,516 A * 12/1969 Ruth ..... F42B 5/184 102/433
3,486,451 A * 12/1969 Moore ..... F42B 5/10 102/517
3,501,858 A * 3/1970 Hensley ..... F41A 19/13 42/16
3,528,187 A * 9/1970 Harrell ..... F42B 5/184 42/76.01
3,540,141 A * 11/1970 Butler ..... B25C 1/186 89/7
3,598,052 A * 8/1971 Schwartz ..... F42B 5/18 102/431
3,602,086 A * 8/1971 Billingslea ..... F41A 19/56 102/431
3,613,587 A * 10/1971 King ..... F42B 5/184 102/700
3,628,456 A * 12/1971 Harrell ..... F42B 5/184 102/433
3,641,692 A * 2/1972 Wells ..... F41A 5/24 89/185
3,641,935 A * 2/1972 Gawlick ..... F42B 3/04 60/39.461
3,718,089 A * 2/1973 Wiese ..... F42B 5/184 102/700
3,722,123 A * 3/1973 Parisi ..... F41A 9/375 42/16
3,726,222 A * 4/1973 White ..... F42B 5/08 102/431
3,753,307 A * 8/1973 Usel ..... F41A 15/04 42/25
3,815,503 A * 6/1974 Infantino ..... F42B 15/00 102/374
3,916,792 A * 11/1975 Elmore ..... F41A 9/65 102/431
4,000,697 A * 1/1977 Levine ..... F42B 5/184 102/700
4,038,923 A * 8/1977 Cole ..... F42B 5/105 102/432
4,123,963 A * 11/1978 Junker ..... F41A 15/20 102/431
4,187,781 A * 2/1980 Flanagan ..... C06B 45/12 102/431
4,282,813 A * 8/1981 Sterbutzel ..... F42B 5/192 102/431
4,395,838 A * 8/1983 Civolani ..... F41A 15/20 42/25
4,782,758 A * 11/1988 Washburn ..... F42B 5/045 102/434
5,215,419 A * 6/1993 Steinhilber ..... F16B 19/14 411/440
5,768,815 A * 6/1998 Casull ..... F41A 15/12 42/16
6,581,522 B1 * 6/2003 Julien ..... F42B 5/192 102/431
6,839,997 B2 1/2005 Popikow
7,380,362 B2 6/2008 Curry et al.
9,429,406 B2 * 8/2016 Harrison ..... F42B 12/02
10,852,107 B1 * 12/2020 Wu ..... F42B 5/18
10,890,420 B1 * 1/2021 Feller ..... F42B 33/00
2003/0056416 A1 * 3/2003 Crowson ..... F42B 14/02 102/527
2005/0115127 A1 6/2005 Szabo
2005/0188872 A1 * 9/2005 Oertwig ..... F41A 19/63 102/202
2006/0169164 A1 * 8/2006 Brus ..... F42B 5/18 102/431
2007/0089598 A1 * 4/2007 Courty ..... F42B 5/08 89/196
2007/0144393 A1 * 6/2007 Kusz ..... F42B 5/10 102/374
2007/0289474 A1 * 12/2007 Mutascio ..... F42B 5/02 102/431
2008/0257139 A1 * 10/2008 Harrison ..... F42B 5/188 86/51
2012/0260814 A1 * 10/2012 Worrell ..... F42B 30/02 102/431
2012/0318161 A1 * 12/2012 Mutascio ..... F42B 5/181 102/431
2018/0156590 A1 * 6/2018 Reuther ..... F42B 12/382
2020/0232731 A1 * 7/2020 Sharkov ..... F41G 1/30
2020/0292282 A1 * 9/2020 Makarov ..... F41A 15/20
2022/0282945 A1 * 9/2022 Makarov ..... F41A 21/34

FOREIGN PATENT DOCUMENTS

RU 2135938 C1 8/1999
RU 2153145 C1 7/2000
RU 2363905 C1 8/2009
RU 2549599 C1 4/2015
UA 49188 A 9/2002

* cited by examiner

CASELESS AMMUNITION FOR FIREARM AND THE MECHANISM FOR THE EXTRACTION OF CASELESS AMMUNITION

The group of inventions relates to field of arm engineering, notably to the caseless ammunition and a mechanism that allows you to extract caseless ammunition reliably.

There are different constructions of caseless ammunition, when the bullet is inside the head space of the propellant charge, developed in Austria, 1983-1994, 1980-1986, France, Germany, 1974-1987, 1969-1975 the USA. The disadvantage of ammunition when a bullet is inside the head space is that there are complicated constructions of the weapon G 11 Germany, the LSAT the USA, and there is also a possibility of self-ignition of ammunition in the chamber of weapon and magazines during the long shooting, insecurity of ammunition during transportation, loss of its features during long storage. Construction, when the propellant charge is in the bullet, that was developed in the USA for the weapon Volkanik 1860, Gyroyjet 1965—their disadvantages are the low power of the ammunition which is from 30 to 250 J. and the lack of precision of the weapon, large dispersion, low performance reliability, high cost of manufacturing.

From the prior art, caseless ammunition for firearms is known (Patent RU No 2153145, IPC F42B 5/18, publ. Jul. 20, 2000 Bul. Ns 20) which comprises a body, a core, a flammable material, where the core has contact surface with the flammable material, and has shape of cone or pyramid with an angle of 50-170°, that directed to the axis of ammunition with its top to the rear part and the body in the rear part of the ammunition, which is perpendicular to the axis of the ammunition, has a turbine with 2-8 guiding elements, that is covered outside by a layer of the flammable material, wherein its thickness 0.2-3 mm, herewith a turbine is made of a high-temperature material; it has a thickness of 1.5-4 mm and with the body and core reaches object of destruction.

The disadvantages of this solution are:

- substantial body drag that occurs during the bullet flight, because of the conical shape of the body;
- during the combustion of the propellant turbine will be pulled out by high gas pressure to 300 kg/cm$^2$ due to press fit holder and as a result it will remain in the chamber of the weapon that will not allow to send next ammunition;
- absence of the primer of the igniter in ammunition and military weapons dependence on electric energy source reduces the reliability of the weapon, especially in case of bad weather conditions (rain, fog, snow).

Known artillery round (Patent RU No 22135938, IPC F42B 5/18, publ. Aug. 27, 1999) comprises warhead with driving band filled with propellant charge, combustion chamber with a receiver separated by a horizontal perforated diaphragm with a membrane, gasket and a primer. The combustion chamber is made in the form of a bush permanently joined to the warhead body where gasket, made as plate spring, is positioned, horizontal perforated diaphragm is located at the bush end face above the receiver and the propellant charge is located between gasket and horizontal perforated diaphragm.

The disadvantage of this solution is that the artillery ammunition can be used only for grenade launchers of 20 mm and higher, using high pressure in the combustion chamber and low pressure in the receiver together with the volume of the grenade launcher in the breech assembly, for a grenade volume—creating a chamber of low pressure, and ammunitions is not acceptable for hand small arms.

In addition, manufacture of artillery ammunitions requires a high manufacturing complexity and precision of the components, that increases the cost and decreases the reliability of the construction.

Known cartridge (Patent RU No 2113686, IPC F42B 5/18, publ. Jun. 20, 1998) comprises a bullet, a propellant charge of a flammable material and a primer-igniter in which the bullet is made in the form of a hollow cylinder, provided with a membrane-wad, which is connected with the primer-igniter by a rod, passing along the bullet axis, and the propellant charge is positioned in the bullet cavity behind the membrane.

The disadvantages of this solution are:

- substantial body drag that occurs during the bullet flight due to projecting inner rear part of driving band; as a rim for holding the high forces, which arise from the membrane, on which high gas pressure influences, during the combustion of the propellant, should, at least, has a height equal two-three wall thicknesses of hollow thin walled cylinder, that forms body drag in end surface of the rim and vortex flow occurs the rim, as a result bullet can start tumbling;
- during motion of the stabilizer and a membrane, that has a disc shape and which is connected by rod into the rear part of bullet, due to incoming air flow, it is necessary to manufacture membrane disc is equal to three or four thicknesses of the wall of the hollow thin-walled cylinder, otherwise during the combustion of the propellant membrane disc can deform and wedge in hole, formed by the rim, due to the high gases pressure, that will result in destabilization of a bullet flight. Meanwhile the disk of membrane, which is equal to three or four thicknesses of the wall of the hollow thin walled cylinder, with rod will have a weight comparable to the weight of bullet and during moving to the rear part they will rapidly change gravity center 'of the system 'bullet-membrane', which can also lead to destabilization of the bullet flight;
- protruding primer-igniter, which is put on the rod and located in the rear part of the ammunition, bulges out, as a result it is unsafe during the transportation and using of such ammunitions, and non-authorized accumulation and explosion of ammunition can occur;
- manufacture of these ammunitions requires high complexity and precision of manufacture of components (hollow thin-walled cylinder with an internal projection, the disk, connected by the rod, primer-igniter, flat stabilizer, a film of binding glue-material) which increases the cost and decreases the reliability of the construction.

This solution is the first prototype of the proposed technical solution.

From the prior art, mechanism for extraction of ammunitions and/or cartridge cases in a weapon with convertible barrel is known (U.S. Pat. No. 6,839,997 B2, the IPC F41A15/06, F41A3/00, publ. May 5, 1992). Device for removal of cartridges and/or cartridge casings in a drop-barrel weapon, with at least one cartridge ejector axially displaceable in a barrel part for removal of unfired cartridges and an ejector mechanism acting on the cartridge ejector for ejection of spent cartridge casings, comprising the ejector mechanism has a locking pin, displaceable in the cartridge ejector, for releasable locking of the cartridge ejector in the barrel part, and a guide pin arranged in the cartridge ejector that engages on the cartridge ejector via a compression spring arranged in the interior of the cartridge ejector and can be displaced by a tension slide arranged on the barrel part, the locking pin being displaceable via an ejector firing pin operated by a striking pin piece into an advanced position, in which the cartridge ejector is locked relative to the barrel part via a locking mechanism, and the locking pin having a front end pin, via which, during fill pivoting of the barrel part, the locking pin is pushed back by the guide pin into its rear position, in which locking of the cartridge ejector is released relative to the barrel part by the locking mechanism.

The disadvantage of this solution is the presence of cylindrical components, that slides in the tube of the barrel, working in tight conditions, and as a result dust pollution or contamination of the mechanism leads to unavoidable wedging of the mechanism and impossibility to extract the case. Also, this solution does not have a method of automatic removal of the case from the gun barrel, what makes the mechanism inapplicable to the weapon with automatic or semi-automatic reloading.

Known the extractor unit with one part (US20050115127 A1, МПК F41A15/14, publ. Jun. 2, 2005) which includes an elongate extractor body configured to be disposed in the opening of the slide such that the slide encloses the extractor body. The elongate extractor body includes a first end and a second end. The second end of the extractor body is resiliently biased in a direction toward a round of ammunition and includes a portion configured to engage a rebate on a round of ammunition. The disadvantage of this solution is the high probability of wedging or disruption to ammunition feed during shooting from the weapon, as well as a bore in the bottom of the case is required for this type of extractor what increases the cost of the ammunition.

Known extraction mechanism for firearm (Патент U.S. Pat. No. 7,380,362 B2, МПК F41A 15/00, F41A 15/10, publ. Jun. 3, 2008) which comprising an extractor arm pivotally mounted within a pocket in a firearm slide. The extractor arm includes a body portion and a hook portion, the body portion being disposed within the pocket and the hook portion extending out of the pocket from an opening proximate to the breech face. The disadvantage of this solution is the technologically complex components of the mechanism, which operates in tight space, springs, also the mechanism is not protected from contamination by the external environment, that leads to dust pollution and contamination of the mechanism components. All the above-mentioned factors result in the wedging of the mechanism.

When all kinds of small arms used, during long-term firing it is desirable to delay the moment of self-ignition of ammunition in heated weapon. During transportation of bulk ammunition, especially on rough terrain, due to shattering picket bullet of ammunition may fire primer-igniter which is close to ammunition, and therefore it is required to make acute end of bullet with platform, and primer-igniter—with increased rigidity. The relatively blunt end of the picket bullet decreases the range ability and bullet penetrating power, so it is desirable to make a bullet with an point end, and a primer—with less rigidity.

During shooting from weapon in closed spaces and within flying vehicles there is a danger that different devices are hit and wedged by cases, ricochet of cases from helicopter rotors may injure soldier. Due to the ricochet of the case soldier can get a burn, if there are cases under the legs, they can cause loss of balance and fall. Besides, the case has ⅔ of the weight of the ammunition, and therefore it increases the weight of the carriable amount of ammunition, and there are additional mechanisms in the operation of the weapon, slots and windows for extraction of the case required and that drastically decreases the reliability of the weapon. It is desirable to take case away and simplified the extraction.

During usage of caseless ammunition with U-shaped chamber it is desirable to enhance power of ammunition and in so doing to reduce the weight without changing its dimensions. When all kinds of small arms with open chamber are used, it is desirable to have extraction only in manual reloading, it is desirable to eliminate extraction during.

During shooting from the weapon additional mechanisms, slots and windows for extraction of case are required what drastically decreases the reliability of the weapon. It is desirable to simplify extraction for weapon with open chamber.

The aim of the first proposed invention is to delay the moment of self-ignition of ammunition in heated weapon, to enhance the power of the caseless ammunition and to reduce its weight without changing its dimensions, to protect the primer from accumulation by the front point end of the ammunition, to reduce the losses of the shell velocity, to increase the penetrating power.

The aim of the second proposed invention is to simplify extraction of the proposed ammunition. This objective is achieved in that extraction is simplified by means of expanding ring or magnetic extraction washer-marker in ammunition, since these parts participate in extraction on a one-off basis during shooting and they are simple.

Another aim of mentioned invention is to provide reliability of ammunition extraction. This objective is achieved in that the extraction of the ammunition is actuated only in manual reloading, and during the shooting the extraction mechanisms are not actuated. Reliability of extraction is considerably increased thanks to expanding ring or magnetic extraction washer-marker in ammunition, since these parts participate in extraction on a one-off basis during shooting and they are simple.

The aim of first proposed invention can be achieved by proposed caseless ammunition which comprising a shell, the propellant (solid, liquid, gas) of flammable material which is placed in the shell chamber, and an igniter block, which is characterized in that the shell body is made with a cylindrical part (25), which passes into an inclined surface (26) of the leading cylindrical part (29), which passes into the rear cylindrical part (30), herewith:

said inclined surface (26) is made at an angle (d27) 30°-45° to the longitudinal axis (28) of the shell body;

said leading cylindrical part (29) is made with a wall thickness (T29);

the thickness (129) of the leading cylindrical part (29) is 0.122D, where D—outside diameter of the ammunition, said rear cylindrical part (30) is made with smaller diameter than the diameter of the leading cylindrical part (29);

between the leading cylindrical part (29) and the rear cylindrical part (30) the ledge (31) is made;

rear cylindrical part (30) ends with a chamfer (32);

the inlet interior cylindrical hole (33) is made in the body of the shell, into which an igniter block (4) or (5) or (22) is installed.

In addition, the fore-part of the shell body (2) is made as a lancet section (23) with an acute end (24) and the inlet interior cylindrical hole (33) which is made in the shell body (2) passes into the middle cylindrical hole (34) which via a conical transition (35) passes into the conical hole (36) which passes into ogive hole (37), wherein the middle cylindrical hole (34), a conical transition (35), conical hole (36) and the ogive hole (37) form a shell chamber (38) for the propellant (3).

In addition, the fore-part of the shell body (7) is made as a truncated cone (39) with an ogival tip (40) and the inlet interior cylindrical hole (33) which is made in the shell body (7), passes into the middle cylindrical hole (34) which via a conical transition (35) passes into the conical hole (36) which passes into ogive hole (37), wherein the middle cylindrical hole (34), a conical transition (35), conical hole (36) and the ogive hole (37) form a shell chamber (38) for the propellant (3).

In addition, the fore-part of the body (41) of the shell (9) is made as a lancet section (23) with a flat end (45) and blind hole (46), into which armor-piercing tip (42) is installed, which is made as a cone (47) with an acute end (24) and the cylindrical ledge (48) and the inlet interior cylindrical hole (33) which is made in the body (41) of the shell (9) passes into the middle cylindrical hole (34), which via a conical transition (35) passes into the conical hole (36) which passes into the ogive hole (37), wherein the middle cylindrical hole (34), a transition cone (35), the conical hole (36) and the ogive hole (37) form a shell chamber (38) for the propellant (3).

In addition, the fore-part of the body (43) of the shell (11) is made as a lancet section (23) with a flat end (45) and blind hole (46) and through hole (49), wherein in a blind hole (46) and a through hole (49) armor-piercing core tip (44) is installed, which is made as a cylindrical head (50), that passing into a conical end (51) with an acute end (24), on one side, and passing into a cylindrical rod (52) on other side, and at the end of the cylindrical rod (52) a chamfer (53) is made and the inlet interior cylindrical hole (33) which is made in the body (43) of the shell (11) passes into the middle cylindrical hole (34), which via a conical transition (35) passes into the conical hole (36) which passes into an ogive hole (37), wherein the middle cylindrical hole (34), a transition cone (35), the conical hole (36) and the ogive hole (37) form a shell chamber (38) for the propellant (3).

In addition, the fore-part of the shell body (13) is made as a lancet section (23) with an acute end (24) and the inlet interior cylindrical hole (33) which is made in the shell body (13) passes into the middle cylindrical hole (34) which via a conical transition (35) passes into the conical hole (36) which passes into an ogive hole (37), wherein washer (15) is additionally installed in ammunition, a chamfer (56) of which bears against a conical transition (35), wherein the middle cylindrical hole (34) forms a shell chamber (38) for the propellant (3) and the tracer compound (14) is placed in the ogive hole (37) and the conical hole (36).

In addition, in the body (57) of the shell (17) in an end face (60) of the cylindrical part (25) is made a cylindrical ledge (61) on which tip (58) is installed, which is made as a lancet section (23) with an acute end (24) and in the end face (62) of the lancet section (23) interior entering chamfer (63) is made, which passes into the blind cylindrical hole (64), wherein the middle cylindrical hole (34) and ogive hole (37) forms a shell chamber (38) for the propellant (3).

In addition, in the body (57) of the shell (19) in an end face (60) of the cylindrical part (25) is made a cylindrical ledge (61) on which the tip (59) is installed, which is made as a truncated cone (39) with ogive tip (40) and in the end face (62) of the trincated cone (39) interior entering chamfer (63) is made which passes into the blind cylindrical hole (64), wherein the middle cylindrical hole (34) and ogive hole (37) forms a shell chamber (38) for the propellant (3).

In addition, the fore-part of the shell (21) is made as a lancet section (23) with an acute end (24) and the inlet interior cylindrical hole (33) is made in the shell body (21), passes into the middle cylindrical hole (34), which passes into a conical hole (65), wherein in the inlet interior cylindrical hole (33) a training igniter block is installed (22).

It is preferably that an igniter block (4), comprising a body (66) which is made as small cylindrical section (73) passing into a big cylindrical section (74), herewith:

- in the end face (75) of the small cylindrical section (73) central seed hole is made (76);
- in the end face of the big cylindrical section (74) a blind hole (77) is made, which passes into smaller blind hole (78);
- in the body (66) of said igniter block (4) primer of igniter block with an anvil (67), the interior washer (68), expanding ring (69) and the external washer-marker (70) which is made as a cylinder (79) with an interior cylindrical hole (80) are consistently installed;
- an interior cylindrical hole (80) passes into the small base of the conical section (81) with a smaller diameter;
- on a cylinder (79) external chamfer (82) is made from the side of the interior cylindrical hole (80).

It is preferably that an igniter block (5) comprises a body (66) made in the form of small cylindrical section (73) which passes into a big cylindrical section (74), wherein:

- in the end face (75) of the small cylindrical part (73) the central seed hole (76) is made;
- in the end face of the big cylindrical section (74) a blind hole (77) is made, which passes into a smaller blind hole (78);
- in a body (66) of said igniter block (5) the primer of igniter block with anvil (67) and the magnetic extraction washer-marker (71) are consistently installed.

It is preferably that an igniter block (22) comprises a body (66) made in the form of small cylindrical section (73) which passes into a big cylindrical s (74), wherein:

- in the end face (75) of the small cylindrical section (73) the central seed hole is made (76);
- in the end face of the big cylindrical section (74) a blind hole (77) is made, which passes into smaller blind hole (78);
- in the body (66) of said igniter block (5) sterile primer (72) and the magnetic extraction washer-marker (71) are consistently installed.

In addition, between the primer with an anvil (67) in the igniter block (4) and the front acute end (24) of the ammunition, which bears against lancet section (23) on the external washer-marker (70), gap (83) is made, wherein the thickness (T83) of the gap (83) is equal to 0.05D, where D—outside diameter of the ammunition.

In addition, between the primer with an anvil (67) in the igniter block (5) and the front acute end (24) of the ammunition, which bears against lancet section (23) on the magnetic extraction washer-marker (71), a gap (83) is made, wherein the thickness (T83) of the gap (83) is equal to 0.05D, where D—outside diameter of the ammunition.

In addition, the external washer-marker (70) is made in different colors.

In addition, the magnetic extraction washer-marker (71) is made in different colors.

In addition, an igniter block (4) for the mechanical extraction is made of flammable material.

Besides, an igniter block (5) for the mechanical extraction is made of flammable material.

The aim of second proposed invention can be achieved by proposed mechanism for extraction caseless ammunition comprises the receiver (84) interacting with the lid of the receiver (85) which is made with possibility to make in and out movement;

lock frame (86) which is made with possibility to make in and out movement and interacts with the lid of the receiver (85);

the bolt (88) is made in the lock frame (86), and installed with possibility to make in and out movement;

a conical bushing (93) is installed inside the bolt (88) through the firing pin (89); an extractor (95) which is made with possibility to rotate on the shaft (103) in the receiver (84), which is characterized in that lock frame (86) is made with a front ledge (87);

on the front end of the firing pin (89) the conical part (90) is made, which passes into a cylindrical section of smaller diameter (91), wherein at the juncture of the conical section (90) and cylindrical section of smaller diameter (91) inclined ledge (92) is formed;

conical bushing (93) is made with interior ledges (94); an extractor (95) is made with a ledge (96) with a semicircular hollow (97) which passes into an upper ledge (98) which has a front inclined area (99) and a rear inclined area (100) and the upper ledge (98) passes into the fore-part (101) which passes into the rear part (102); a shaft (103) with a circular groove (104) which is placed on the contact point of the fore-part (101) and the rear part (102), wherein the rear part (102) passes into the lower ledge (106) which has a front inclined area (107) and a rear horizontal area (108) and the lower ledge (106) passes into the upper ledge (109) which has a front inclined area (110), an upper horizontal area (111) and a rear inclined area (112).

In addition, the angle (d92) of inclined ledge (92) about the axis of the firing pin (89) is 30-45 degrees.

In addition, between the end face of conical section (90) of the firing pin (89) and a primer with an anvil (67) of igniter block (4,5) of the caseless ammunition a gap (114) is made.

In addition, the thickness (T114) of the gap (114) is 0.03-0.05D, wherein D—outside diameter of the ammunition.

In addition, the conical bushing (93) on the bolt (88) forms a gap (115) with the rear end of the ammunition.

In addition, the thickness (T115) of the gap (115) is equal to 0.2D, wherein D—outside diameter of the ammunition.

In addition, the mechanism works only with hand reloading.

Novel features of the group of inventions are:

the thickness (T29) of the leading cylindrical part (29) is 0.122D, where D—outside diameter of the ammunition, which is 1.5-2 times greater than thickness of side wall at case bottom of traditional ammunition for small arms, where thickness of side wall at case bottom equals (0,052-0,078) $D_{sb}$, where $D_{sb}$ is outer diameter at case bottom. This structural feature provides a great inertia of the shell heating; thereby the moment of self-ignition of the shell inside the weapon is considerably delayed, wherein the shell can operate in the weapon at pressures close to 620 MPa what is two times higher than that of the traditional small arms, which makes it possible to increase the firing energy;

in the proposed caseless ammunition the igniting blocks are made completely combustible, for example, they are made of nitrocellulose-bases plastic. As a result weight of ammunition is reduced without changing its overall dimensions, and their power increases;

there is a gap between the primer and the anvil of the ignition unit of the caseless ammunition and the front acute end of the ammunition, and the front acute end cannot break the primer. The acute end of the ammunition makes it possible to reduce the air resistance on the whole flight trajectory, thereby it allows to reduce the losses of the shell velocity. Also acute end of ammunition increases penetrating power in soft jackets thanks to extension of cells of cloth, and in solid armored jackets thanks to concentration of stresses on considerably smaller area in front acute end;

the propellant is located inside the ammunition, thanks to this and the structural features of the weapon there is provided a new method of shooting. This makes it possible to develop the necessary energy for particular types of weapons. It also allows to have different kinds of weapons for one type of ammunition and one structure;

at the joint of the conical part and the cylindrical part with the smaller diameter on the front end of the firing pin, the inclined shelf is formed, which opens the expanding ring for mechanical extraction and the firing pin with the igniting block drops out of gear and a conical bushing on the bolt gets a gap with rear end of proposed ammunition;

conical section is formed on the front end of the firing pin, during magnetic extraction that conical section is beyond the magnetic extraction washer-marker of the igniter block, wherein the magnetized magnetic extraction washer-marker torns off from the firing pin, and the conical bushing on the bolt gets a gap of certain thickness with the rear end of the ammunition. The thickness of the gap does not allow the rear end of the ammunition to engage the conical bushing during ejection beyond the weapon, what provides reliability of the loading cycle, reloading cycle.

Figure 1:
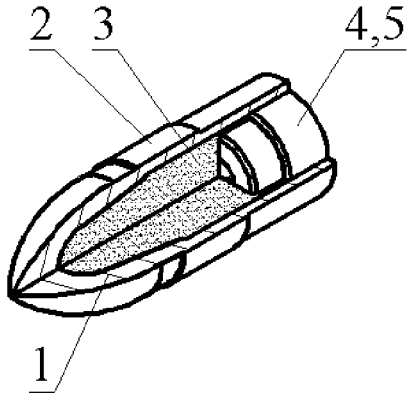
FIG. 1. Acute caseless ammunition, hereafter—caseless ammunition 1 (side view).

Designations on the figures of the drawings which have been used in the claimed invention:

1—caseless ammunition;
2—shell;
3—propellent;
4—igniter block;
5—igniter block;
6—caseless ammunition;
7—shell;
8—caseless ammunition;
9—shell;
10—caseless ammunition;
11—shell;
12—caseless ammunition;
13—shell;
14—tracer compound;
15—washer;
16—caseless ammunition;
17—shell;
18—caseless ammunition;
19—shell;
20—caseless ammunition;
21—shell;
22—training igniter block;
23—lancet section;
24—acute end;
25—cylindrical part;
26—inclined surface;
27—acute angle;
d27—measure of an acute angle;
28—longitudinal axis;
29—leading cylindrical part;
T29—thickness of a leading cylindrical part;
30—rear cylindrical part;
31—ledge;
32—chamfer;
33—inlet interior cylindrical hole;
34—middle cylindrical hole;
35—conical transition;
36—conical hole;
37—ogive hole;
38—shell chamber for propellent;
39—truncated cone;
40—ogive tip;
41—body;
42—armor-piercing tip;
43—body;
44—armor-piercing core tip;
45—flat end of the lancet section 23;
46—blind hole;
47—cone;
48—cylindrical ledge;
49—through hole;
50—cylindrical head;
51—conical end;
52—cylindrical rod;
53—chamfer;
54—circular plate;
55—central through hole;
56—external chamfer;
57—body;
58—tip;
59—tip;
60—end face;
61—cylindrical ledge;
62—end face;
63—interior entering chamfer;
64—blind cylindrical hole;
65—conical hole;
66—body of igniter block 4; 5; 22;
67—primer of igniter block with anvil;

68—interior washer;
69—expanding ring;
70—external washer-marker;
71—magnetic extraction washer-marker;
72—sterile capsule;
73—small cylindrical section;
74—big cylindrical section;
75—end face;
76—central seed hole;
77—blind hole;
78—smaller blind hole;
79—cylinder;
80—interior cylindrical hole;
81—conical section;
82—external chamfer;
83—gap;
T83—thickness of gap 83;
84—receiver;
85—lid of receiver,
86—lock frame;
87—front ledge of lock flume;
88—bolt;
89—firing pin;
90—conical section;
91—cylindrical section;
92—inclined ledge;
d92—angle of inclined ledge 92;
93—conical bushing;
94—interior ledges;
95—extractor;
96—ledge;
97—semicircular hollow;
98—upper ledge;
99—front inclined area;
100—rear inclined area;
101—fore-part;
102—rear part;
103—shaft;
104—circular groove;
105—contr-washer;
106—lower ledge;
107—front inclined area;
108—rear horizontal area;
109—upper ledge;
110—front inclined area;
111—upper horizontal area;
112—rear inclined area;
113—lower part;
114—gap;
T114—thickness of gap 114;
115—gap;
T115—thickness of gap 115.

Shells are made of steel in the proposed invention.

FULL DESCRIPTION OF THE DRAWING OF INVENTION

FIG. 1 shows caseless ammunition 1 (side view). This configuration comprises: acute shell 2, propellant 3 (solid, liquid and gaseous) and igniter block 4 or 5.

Figure 2:
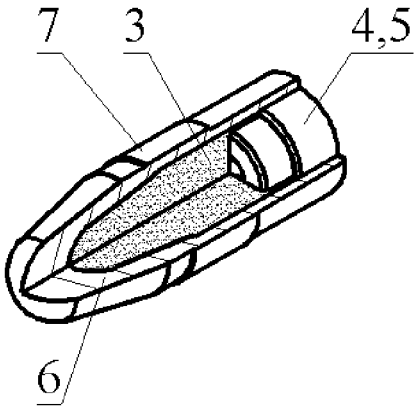
FIG. 2. Blunt-ended caseless ammunition, hereafter—caseless ammunition 6 (side view).

FIG. 2 shows caseless ammunition 6 (side view). This configuration comprises: shell 7, propellant 3 (solid, liquid and gaseous) and igniter block 4 or 5.

Figure 3:
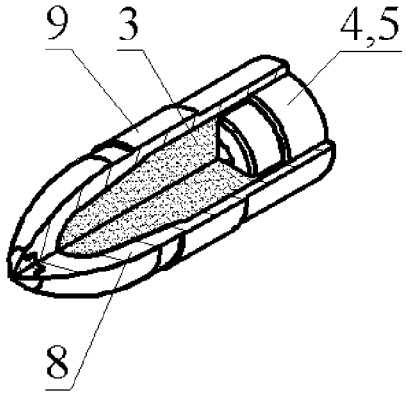
FIG. 3. Armor-piercing caseless ammunition, hereafter—caseless ammunition 8 (side view).

FIG. 3 shows caseless ammunition 8 (side view). This configuration comprises shell 9, propellant 3 (solid, liquid and gaseous) and igniter block 4 or 5.

Figure 4:
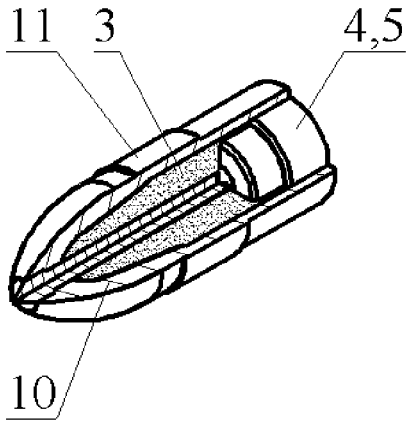
FIG. 4. Enhanced armor-piercing caseless ammunition, hereafter—caseless ammunition 10 (side view).

FIG. 4 shows caseless ammunition 10 (side view). This configuration comprises shell 11, propellant 3 (solid, liquid and gaseous) and igniter block 4 or 5.

Figure 5:
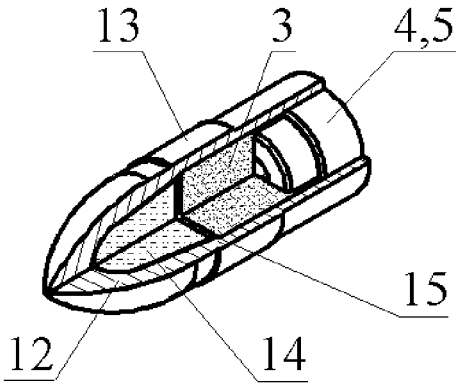
FIG. 5. Tracer caseless ammunition, hereafter—caseless ammunition 12 (side view).

FIG. 5 shows caseless ammunition 12 (side view). This configuration comprises shell 13, propellant 3 (solid, liquid and gaseous) and igniter block 4 or 5, tracer compound 14 and washer 15.

Figure 6:
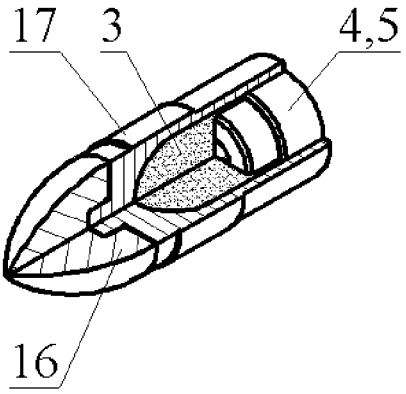
FIG. 6. Acute caseless ammunition for noiseless flameless shooting, hereafter—caseless ammunition 16 (side view).

FIG. 6 shows caseless ammunition 16 (side view). This configuration comprises shell 17, propellant 3 (solid, liquid and gaseous) and igniter block 4 or 5.

Figure 7:
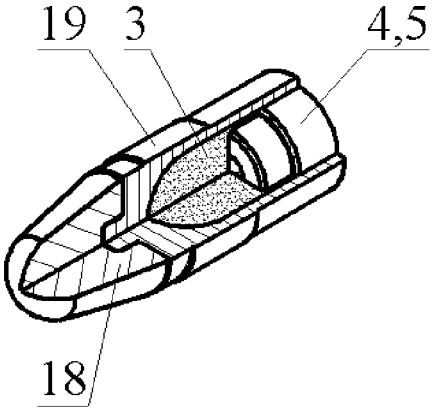
FIG. 7. Blunt-ended caseless ammunition for noiseless flameless shooting, hereafter—caseless ammunition 18 (side view).

FIG. 7 shows caseless ammunition 18 (side view). This configuration comprises shell 19, propellant 3 (solid, liquid and gaseous) and igniter block 4 or 5.

Figure 8:
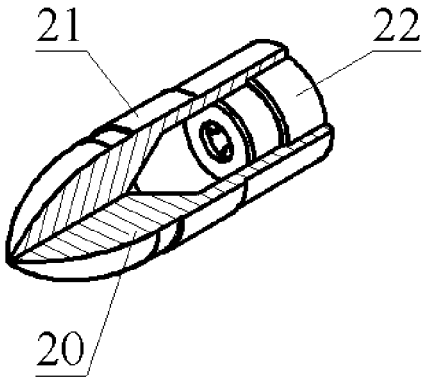
FIG. 8. Training caseless ammunition, hereafter—caseless ammunition 20 (side view).

FIG. 8 shows caseless ammunition 20 (side view). This configuration comprises shell 21 and training igniter block 22.

Figure 9:
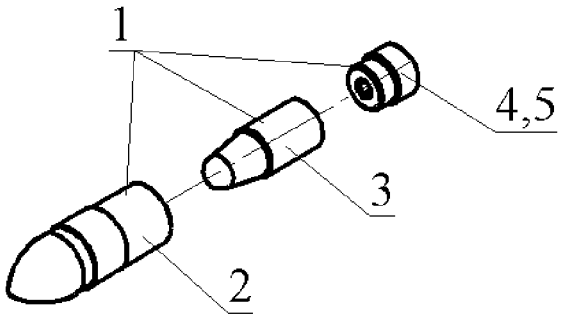
FIG. 9. Caseless ammunition 1, detail design (side view).

FIG. 9 shows detail design of caseless ammunition 1 (side view). This configuration comprises acute shell 2, propellant 3 (solid, liquid and gaseous) and igniter block 4 or 5.

Figure 10:
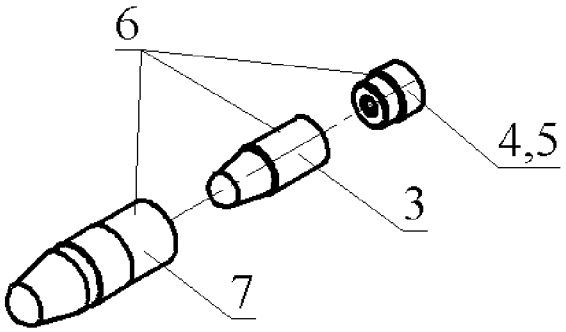
FIG. 10. Caseless ammunition 6, detail design (side view).

FIG. 10 shows detail design of caseless ammunition 6 (side view). This configuration comprises shell 7, propellant 3 (solid, liquid and gaseous) and igniter block 4 or 5.

Figure 11:
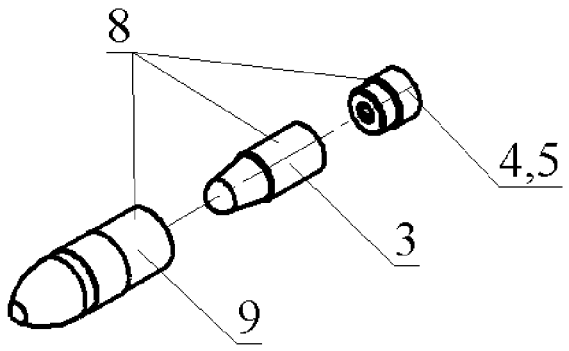
FIG. 11. Caseless ammunition 8, detail design (side view).

FIG. 11 shows detail design of caseless ammunition 8 (side view). This configuration comprises shell 9, propellant 3 (solid, liquid and gaseous) and igniter block 4 or 5.

Figure 12:
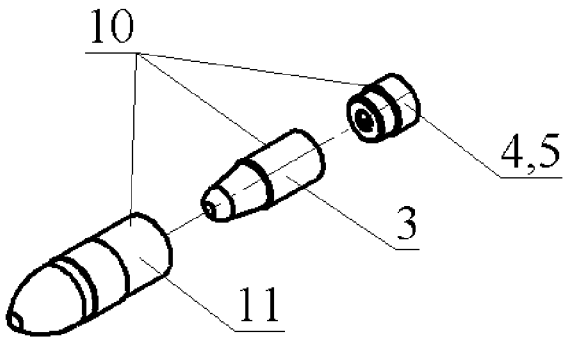
FIG. 12. Caseless ammunition 10, detail design (side view).

FIG. 12 shows detail design of caseless ammunition 10 (side view). This configuration comprises shell 11, propellant 3 (solid, liquid and gaseous) and igniter block 4 or 5.

Figure 13:
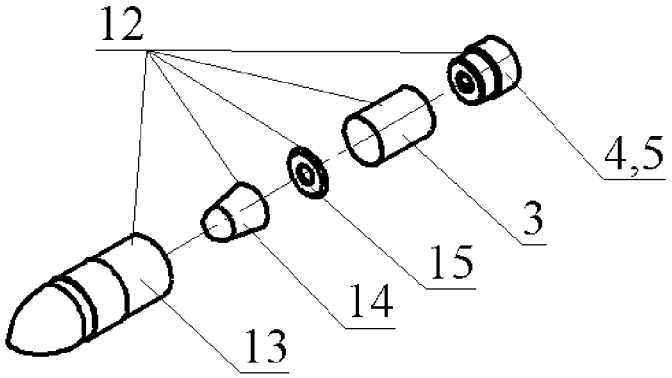
FIG. 13. Caseless ammunition 12, detail design (side view).

FIG. 13 shows detail design of caseless ammunition 12 (side view). This configuration comprises shell 13, propellant 3 (solid, liquid and gaseous) and igniter block 4 or 5, tracer compound 14 and washer 15.

Figure 14:
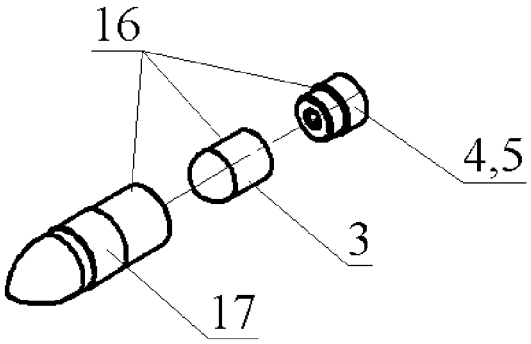
FIG. 14. Caseless ammunition 16, detail design (side view).

FIG. 14 shows detail design of caseless ammunition 16 (side view). This configuration comprises shell 17, propellant 3 (solid, liquid and gaseous) and igniter block 4 or 5.

Figure 15:
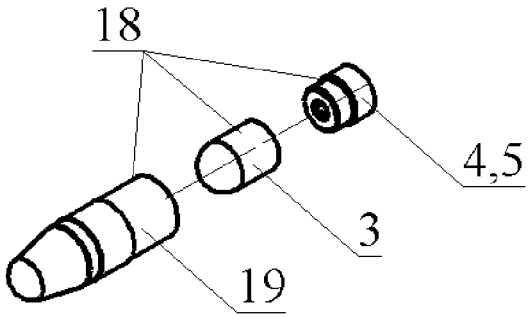
FIG. 15. Caseless ammunition 18, detail design (side view).

FIG. 15 shows detail design of caseless ammunition 18 (side view). This configuration comprises shell 19, propellant 3 (solid, liquid and gaseous) and igniter block 4 or 5.

Figure 16:
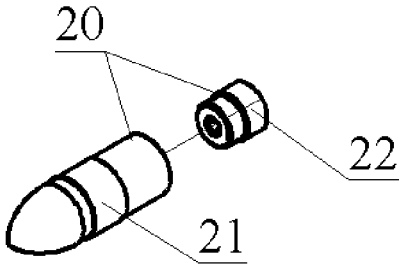
FIG. 16. Caseless ammunition 20, detail design (side view).

FIG. 16 shows detail design of caseless ammunition 20 (side view). This configuration comprises shell 21, propellant 3 (solid, liquid and gaseous) and training igniter block 22.

Figure 17:
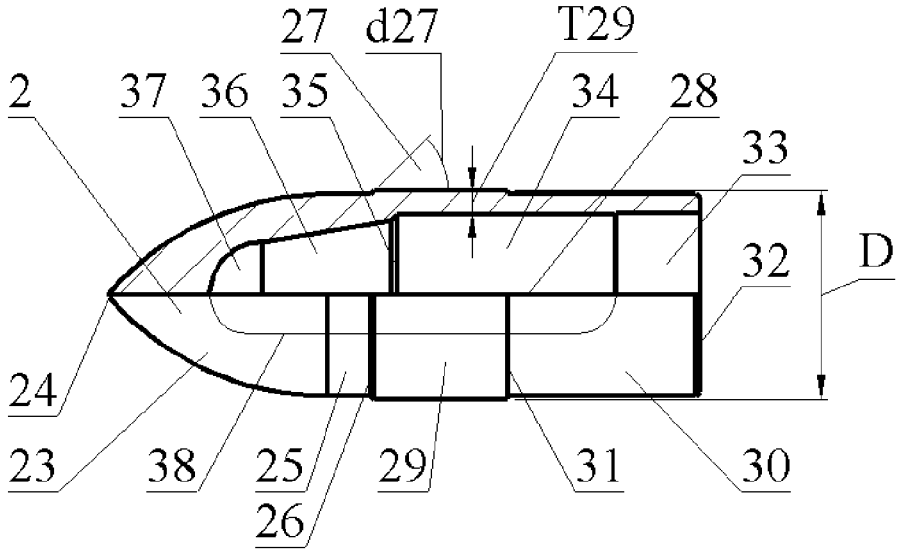
FIG. 17. Acute shell, hereafter—shell 2 (side view).

FIG. 17 shows side view of shell 2. The fore-part of the shell body 2 is made as a lancet section 23 with an acute end 24 which passes into a cylindrical part 25, which passes into an inclined surface 26 of the leading cylindrical part 29, which passes into the rear cylindrical part 30 with smaller diameter.

Inclined surface 26 is made at an angle 27 to the longitudinal axis 28 of the shell 2. Acute angle 27 has measure d27 which is equal to 30°-45° to the longitudinal axis 28 of the shell body, as a result, rifling of ammunition in the weapon occurs in less vulnerable state.

The thickness T29 of the leading cylindrical part 29 is 0.122D, where D—outside diameter of the ammunition, which is 1.5-2 times greater than thickness $T_{swcb}$, of side wall at case bottom of traditional ammunition for small arms, where ($T_{swcb}$=0.052-0.078 $D_{cb}$, where $D_{cb}$ is outer diameter at case bottom), that provides a great inertia of the shell heating. Thereby the moment of self-ignition of the shell inside the weapon is considerably delayed, wherein the shell 2 can operate in the weapon at pressures $P_{max}$=620 MPa, which is two times higher than that of the traditional small arms, which makes it possible to increase the shooting energy.

Between the leading cylindrical part 29 and the rear cylindrical part 30 the ledge 31 is made. Rear cylindrical part 30 ends with a chamfer 32. The inlet interior cylindrical hole 33 is made in the body of the shell 2, into which an igniter block 4 or 5 is installed, the inlet interior cylindrical hole 33 passes into the middle cylindrical hole 34 which via a conical transition 35 passes into the conical hole 36 which passes into ogive hole 37. The middle cylindrical hole 34, a conical transition 35, conical hole 36 and the ogive hole 37 form a shell chamber 38 for the propellant 38. All elements of shell 2, their shapes and interactions are shown on FIG. 17.

Figure 18:
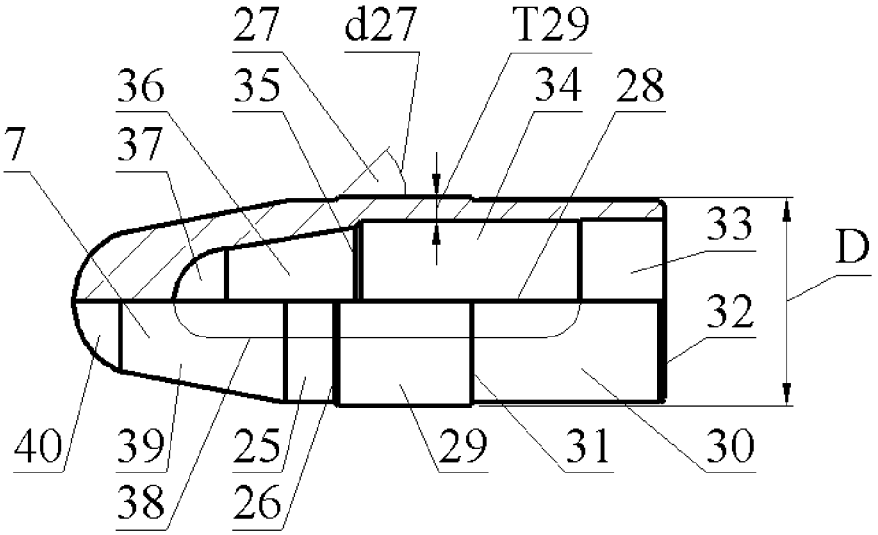
FIG. 18. Blunt-ended shell, hereafter—shell 7 (side view).

FIG. 18 shows side view of shell 7. The fore-part of the shell body (7 is made as a truncated cone 39 with an ogival tip 40. Truncated cone 39 passes into cylindrical part 25, which passes into an inclined surface 26. Inclined surface 26 is made at acute angle 27 to the longitudinal axis 28 of the shell 7.

Acute angle has measure d27 which is equal to 30°-45° to the longitudinal axis 28 of the shell body, as a result, rifling of ammunition in the weapon occurs in less vulnerable state.

The inclined surface 26 of the leading cylindrical part 29 passes into the rear cylindrical part 30 with smaller diameter.

The thickness T29 of the leading cylindrical part 29 is 0.122D, where D—outside diameter of the ammunition; which is 1.5-2 times greater than thickness $T_{swcb}$ of traditional ammunition for small arms, where $T_{swcb}$=0.052-0.078 $D_{cb}$, where $D_{cb}$ is outer diameter at case bottom, that provides a great inertia of the shell heating. Thereby the moment of self-ignition of the shell inside the weapon is considerably delayed, wherein the shell 7 can operate in the weapon at pressures $P_{max}$=620 MPa, which is two times higher than that of the traditional small arms, which makes it possible to increase the shooting energy.

Between the leading cylindrical part 29 and the rear cylindrical part 30 the ledge 31 is made. Rear cylindrical part 30 ends with a chamfer 32. The inlet interior cylindrical hole 33 is made in the body of the shell, into which an igniter block 4 or 5 is installed; the inlet interior cylindrical hole 33 passes into the middle cylindrical hole 34 which via a conical transition 35 passes into the conical hole 36 which passes into ogive hole 37, herewith the middle cylindrical hole 34, a conical transition 35, conical hole 36 and the ogive hole 37. Middle cylindrical hole 34, conical transition 35, conical hole 36 and ogive hole 37 form a shell chamber 38 for the propellant 38. All elements of shell 2, their shapes and interactions are shown on FIG. 18.

Figure 19:
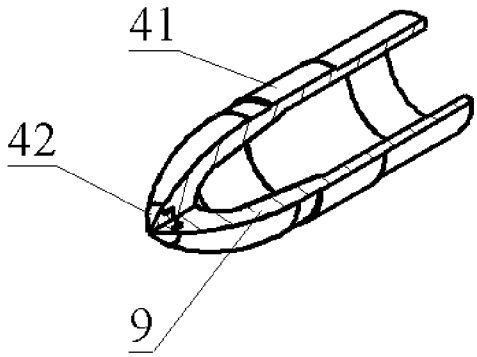
FIG. 19. Acute shell, hereafter—shell 9 (side view).

FIG. 19 shows side view of shell 9. Shell 9 comprises body 41 and armor-piercing tip 42.

Figure 20:
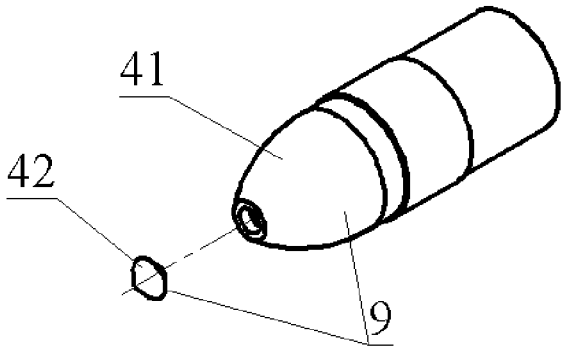
FIG. 20. Shell 9, detail design (side view).

FIG. 20 shows detail design of shell 9, which comprises body 41 and armor-piercing tip 42 (side view).

Figure 21:
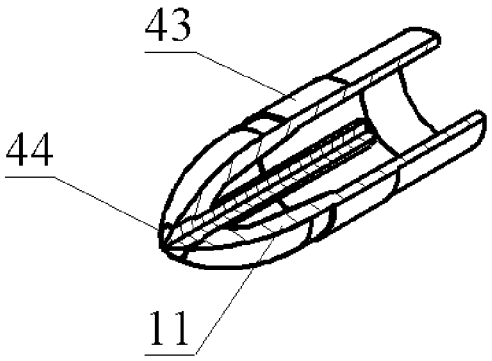
FIG. 21. Acute shell, hereafter—shell 11 (side view).

FIG. 21 shows side view of shell 11. Shell 11 comprises body 43 and armor-piercing tip 44.

Figure 22:
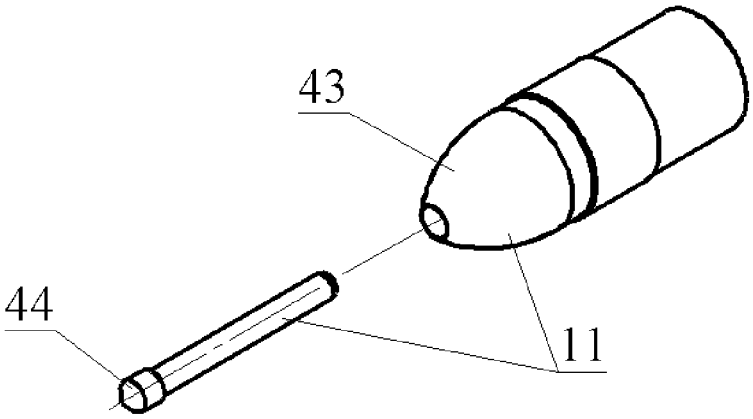
FIG. 22. Shell 11, detail design (side view).

FIG. 22 shows detail design of shell 11, which comprises body 43 and armor-piercing tip 44 (side view).

Figure 23:
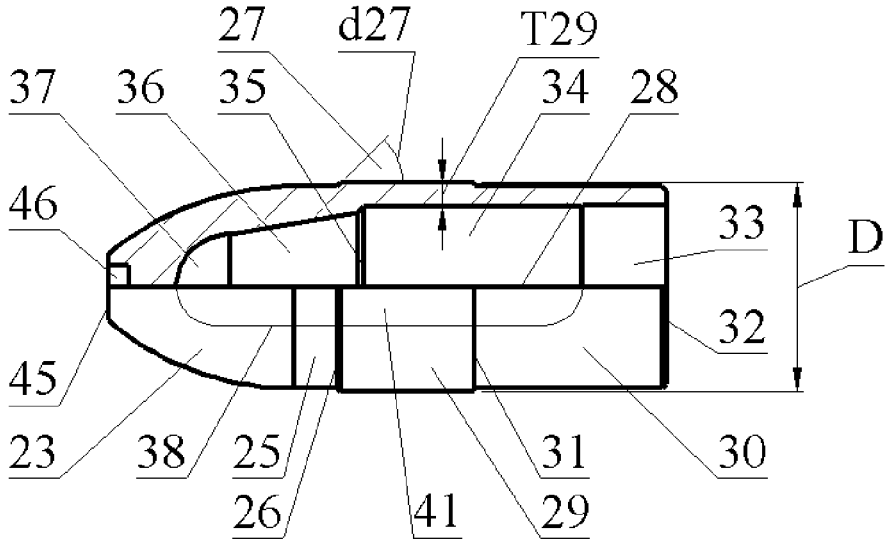
FIG. 23. Body 41 (side view).

FIG. 23 shows side view of body 41. The fore-part of the body 41 of the shell 9 is made as a lancet section 23 with a flat end 45 and blind hole 46, into which armor-piercing tip 42 is installed. A lancet section 23, which passes into a cylindrical part 25, which passes into an inclined surface 26. Inclined surface 26 is made at an angle 27 to the longitudinal axis 28 of the body 41. Acute angle has measure d27 which is equal to 30°-45° to the longitudinal axis 28 of the shell body; as a result, rifling of ammunition in the weapon occurs in less vulnerable state.

The inclined surface 26 of the leading cylindrical part 29 passes into the rear cylindrical part 30 with smaller diameter.

The thickness T29 of the leading cylindrical part 29 is 0.122D, where D—outside diameter of the ammunition; which is 1.5-2 times greater than thickness $T_{swcb}$ of traditional ammunition for small arms, where $T_{swcb}$=0.052-0.078 $D_{cb}$, where $D_{cb}$ is outer diameter at case bottom, that provides a great inertia of the shell heating. Thereby the moment of self-ignition of the shell inside the weapon is considerably delayed, wherein the body 41 can operate in the weapon at pressures $P_{max}$=620 Mpa, which is two times higher than that of the traditional small arms, which makes it possible to increase the shooting energy.

Between the leading cylindrical part 29 and the rear cylindrical part 30 the ledge 31 is made. Rear cylindrical part 30 ends with a chamfer 32. The inlet interior cylindrical hole 33 is made in the body 41, into which an igniter block 4 or 5 is installed; the inlet interior cylindrical hole 33 passes into the middle cylindrical hole 34 which via a conical transition 35 passes into the conical hole 36 which passes into ogive hole 37, herewith the middle cylindrical hole 34, a conical transition 35, conical hole 36 and the ogive hole 37. Middle cylindrical hole 34, conical transition 35, conical hole 36 and ogive hole 37 form a shell chamber 38 for the propellant 3. All elements of body 41, their shapes and interactions are shown on FIG. 23.

Figure 24:
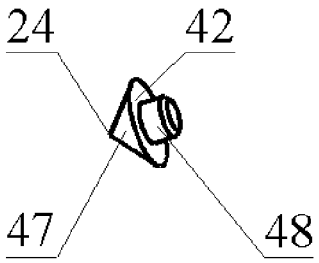
FIG. 24. Armor-piercing tip 42 (side view).

FIG. 24 shows armor-piercing tip 42 side view which is installed in the fore-part and made as a cone 47 with an acute end 24 and the cylindrical ledge 48 for blind hole 46 of body 41. All elements of armor-piercing tip 42, their shapes and interactions are shown on FIG. 24.

Figure 25:
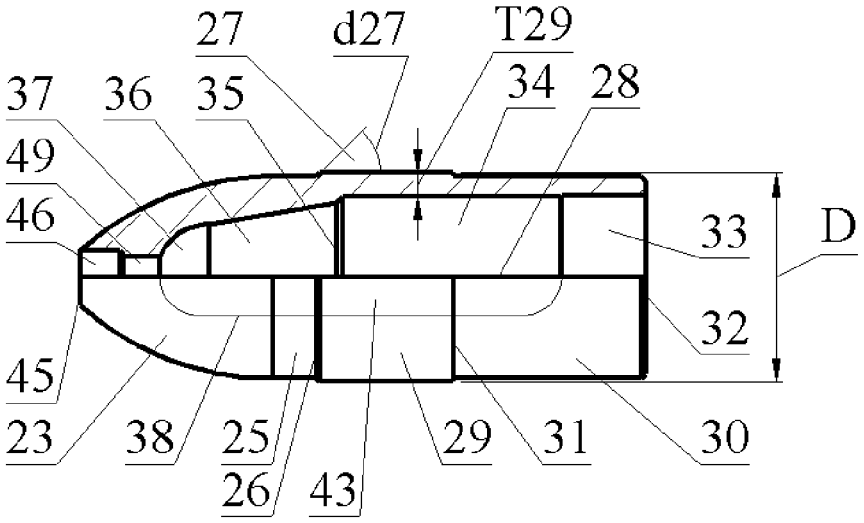
FIG. 25. Body 43 (side view).

FIG. 25 shows side view of body 43 side view. The fore-part of the body 43 of the shell 9 is made as a lancet section 23 with a flat end 45 and blind hole 46 and through hole 49, herewith in a blind hole 46 and a through hole 49 armor-piercing core tip 44 is installed. Lancet section passes into cylindrical part 25, which passes into an inclined surface 26. Inclined surface 26 is made at an angle 27 to the longitudinal axis 28 of the body 43. Acute angle 27 has measure d27, which is equal to 30°-45° to the longitudinal axis 28 of the shell body, as a result, rifling of ammunition in the weapon occurs in less vulnerable state.

The inclined surface 26 of the leading cylindrical part 29 passes into the rear cylindrical part 30 with smaller diameter. The thickness T29 of the leading cylindrical part 29 is 0.122D, where D—outside diameter of the ammunition; which is 1.5-2 times greater than thickness $T_{swcb}$ of side wall at case bottom of traditional ammunition for small arms, where $T_{swcb}$=0.052-0.078 $D_{cb}$, where $D_{cb}$ is outer diameter at case bottom, that provides a great inertia of the shell heating; thereby the moment of self-ignition of the shell inside the weapon is considerably delayed, wherein the body 43 can operate in the weapon at pressures $P_{max}$=620 Mpa, which is two times higher than that of the traditional small arms, which makes it possible to increase the shooting energy.

Between the leading cylindrical part 29 and the rear cylindrical part 30 the ledge 31 is made. Rear cylindrical part 30 ends with a chamfer 32. The inlet interior cylindrical hole 33 is made in the body 43, into which an igniter block 4 or 5 is installed, the inlet interior cylindrical hole 33 passes into the middle cylindrical hole 34 which via a conical transition 35 passes into the conical hole 36 which passes into ogive hole 37, herewith the middle cylindrical hole 34, a conical transition 35, conical hole 36 and the ogive hole 37. Middle cylindrical hole 34, conical transition 35, conical hole 36 and ogive hole 37 form a shell chamber 38 for the propellant 3. All elements of body 43, their shapes and interactions are shown on FIG. 25.

Figure 26:
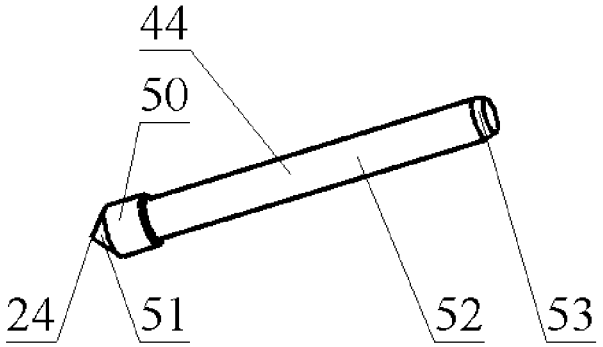
FIG. 26. Armor-piercing core tip 44 (side view).

FIG. 26 shows side view of armor-piercing core tip 44 which is made as a cylindrical head 50, that passing into a conical end 51 with an acute end 24, on one side, and passing into a cylindrical rod 52 on other side. At the end of the cylindrical rod 52 a chamfer 53 is made. All elements of armor-piercing core tip 44, their shapes and interactions are shown on FIG. 26.

Figure 27:
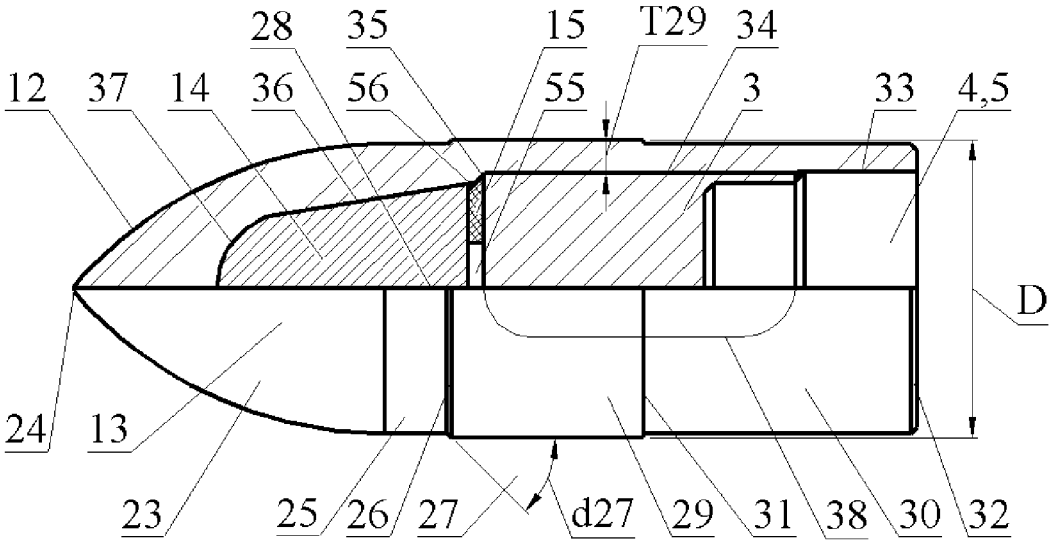
FIG. 27. Tracer ammunition 12, detail design (side view).

FIG. 27 shows side view of shell 13. The fore-part of the shell body 13 is made as a lancet section 23 with an acute end 24. Lancet section 23 passes into cylindrical part 25, which passes into an inclined surface 26. Inclined surface 26 is made at an angle 27 to the longitudinal axis 28 of the shell. Acute angle 27 has measure d27 which is equal to 30°-45° to the longitudinal axis 28 of the shell body; as a result, rifling of ammunition in the weapon occurs in less vulnerable state.

The inclined surface 26 of the leading cylindrical part 29 passes into the rear cylindrical part 30 with smaller diameter.

The thickness T29 of the leading cylindrical part 29 is 0.122D, where D—outside diameter of the ammunition: which is 1.5-2 times greater than thickness $T_{swcb}$ of side wall at case bottom of traditional ammunition for small arms, where $T_{swcb}$=0.052-0.078 D, where $D_{cb}$ is outer diameter at case bottom, that provides a great inertia of the shell heating. Thereby the moment of self-ignition of the shell inside the weapon is considerably delayed, wherein the shell 13 can operate in the weapon at pressures $P_{max}$=620 Mpa, which is two times higher than that of the traditional small arms, which makes it possible to increase the shooting energy.

Between the leading cylindrical part 29 and the rear cylindrical part 30 the ledge 31 is made. Rear cylindrical part 30 ends with a chamfer 32.

The inlet interior cylindrical hole 33 which is made in the shell body 13 passes into the middle cylindrical hole 34 which via a conical transition 35 passes into the conical hole 36 which passes into an ogive hole 37, herewith washer 15 is additionally installed in ammunition, a chamfer 56 of which bears against a conical transition 35, herewith the middle cylindrical hole 34 forms chamber 38 for the propellant 3. The tracer compound 14 is placed in the ogive hole 37 and the conical hole 36. The propellant 3 occupies the middle cylindrical hole 34. Washer 15 bears against conical transition 35 by the chamfer 59 which separates the propellant 3 and the tracer compound 14, thereby it doesn't allow tracer compound to burn out during initial stage of ignition. During ignition burning propellant 3 passes through the central through hole 55 under high pressure and ignites the tracer compound 14. Burnout velocity of tracer compound 14 depends on the size of the central through hole 55. All elements of ammunition 12, their shape and interactions are shown on FIG. 27.

Figure 28:
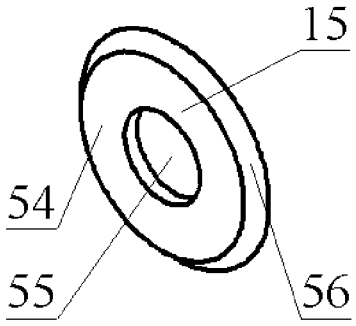
FIG. 28. Washer 15 (side view).

FIG. 28 shows side view of washer 15, which is made as circular plate 54 with central through hole 55 in the middle and external chamfer 56. All elements of washer, their shapes and interactions are shown on FIG. 28.

Figure 29:
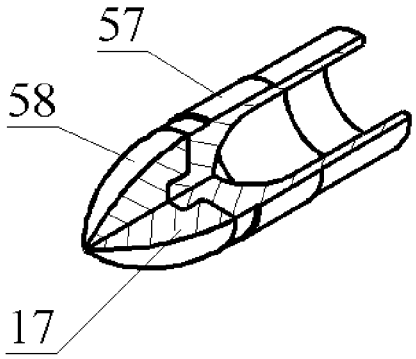
FIG. 29. Acute shell for noiseless flameless shooting, hereafter—shell 17 (side view).

FIG. 29 shows side view of shell 17, which comprises body 57 and tip 58

Figure 30:
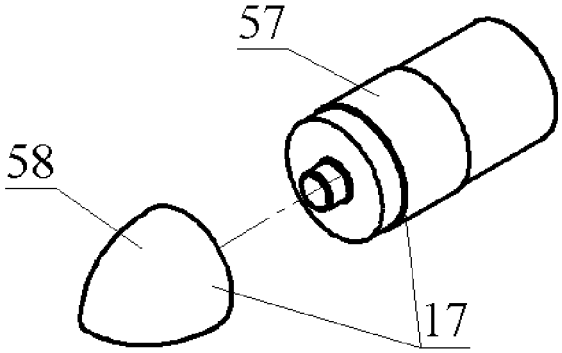
FIG. 30. Shell 17, detail design (side view).

FIG. 30 shows detail design of shell 17, which comprises body 57 and tip 58.

Figure 31:
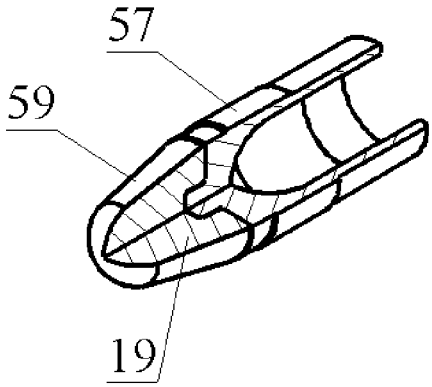
FIG. 31. Blunt-ended shell for noiseless flameless shooting, hereafter—shell 19 (side view).

FIG. 31 shows side view of shell 19, which comprises body 57 and tip 59.

Figure 32:
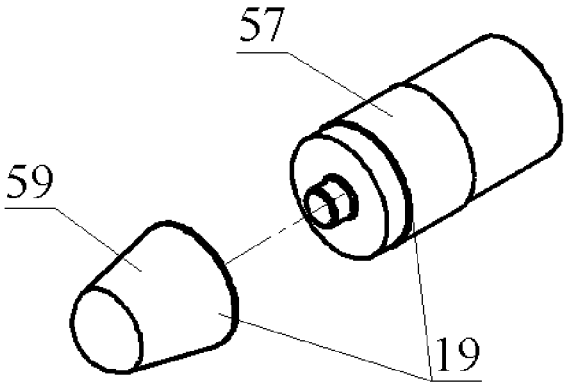
FIG. 32. Detail design of shell 19 (side view).

FIG. 32 shows detail design of shell 19, which comprises body 57 and tip 59.

Figure 33:
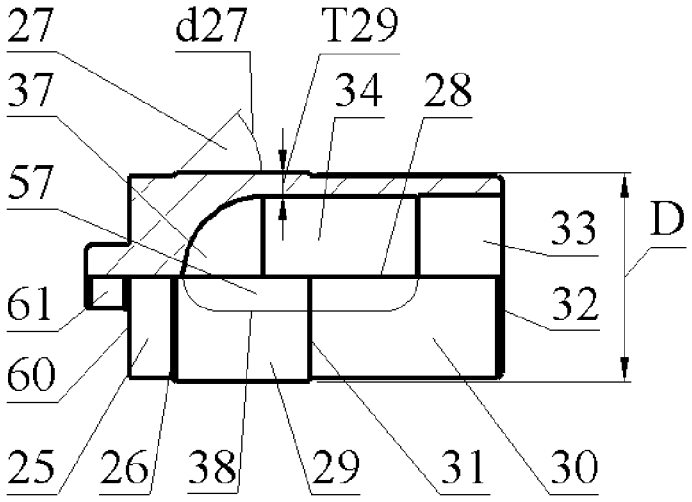
FIG. 33. Body 57 (side view).

FIG. 33 shows body 57. In the body 57 of the shell 17 and shell 19 in an end face 60 of the cylindrical part 25 is made a cylindrical ledge 61 for blind cylindrical hole 64 of the rear part of tip 58 or 59. Cylindrical part 25, which passes into an inclined surface 26 of the leading cylindrical part 29, which passes into the rear cylindrical part 30, with smaller diameter. Inclined surface 26 is made at acute angle 27 to the longitudinal axis 28 of the body 57. Acute angle has measure d27 which is equal to 30-45° to the longitudinal axis 28 of the shell body: as a result, rifling of ammunition in the weapon occurs in less vulnerable state. The thickness T29 of the leading cylindrical part 29 is 0.122D, where D—outside diameter of the ammunition; which is 1.5-2 times greater than thickness $T_{swcb}$ of side wall at case bottom of traditional ammunition for small arms, where $T_{swcb}$=0.052-0.078 $D_{cb}$, where $D_{cb}$ is outer diameter at case bottom, that provides a great inertia of the shell heating; thereby the moment of self-ignition of the shell inside the weapon is considerably delayed, wherein the body 57 can operate in the weapon at pressures $P_{max}$=620 Mpa, which is two times higher than that of the traditional small anus, which makes it possible to increase the shooting energy.

Between the leading cylindrical part 29 and the rear cylindrical part 30 the ledge 31 is made. Rear cylindrical part 30 ends with a chamfer 32. The inlet interior cylindrical hole 33 is made in the body 57, for an igniter block 4 or 5, which passes into the middle cylindrical hole 34 and ogive hole 37. Middle cylindrical hole 34 and ogive hole 37 form a shell chamber for the propellant 38. All elements of body 57, their shapes and interactions are shown on FIG. 33.

Figure 34:
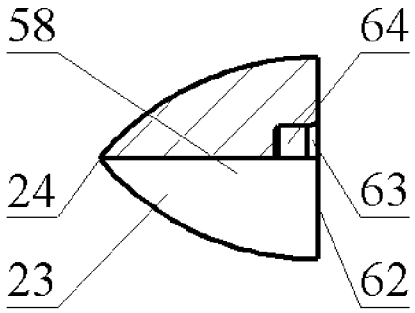
FIG. 34. Tip 58 (side view).

FIG. 34 shows side view of tip 58, which is made as lancet section 23 with an acute end 24. In the end face 62 of the lancet section 23 interior entering chamfer 63 is made, which passes into the blind cylindrical hole 64. Entering chamfer 63 and blind cylindrical hole 64 are made for installation of tip 55 58 into the cylindrical ledge of body 57. All elements of tip 58, their shapes and interactions are shown on FIG. 34.

Figure 35:
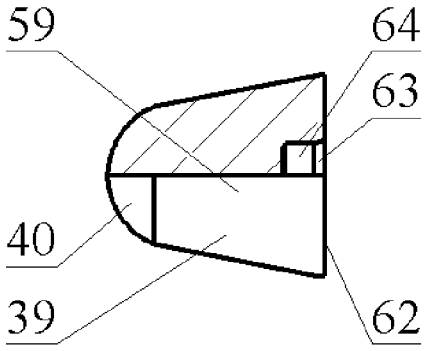
FIG. 35. Tip 59 (side view).

FIG. 35 shows side view of tip 59, which is made as a truncated cone 39 with an ogive tip 40. In the end face 62 of the truncated cone 39 interior entering chamfer 63 is made, which passes into the blind cylindrical hole 64. Interior entering chamfer 63 and blind cylindrical hole 64 are made for installation of tip 59 into the cylindrical ledge 61 of the body 57. All elements of tip 58, their shapes and interactions are shown on FIG. 35.

Figure 36:
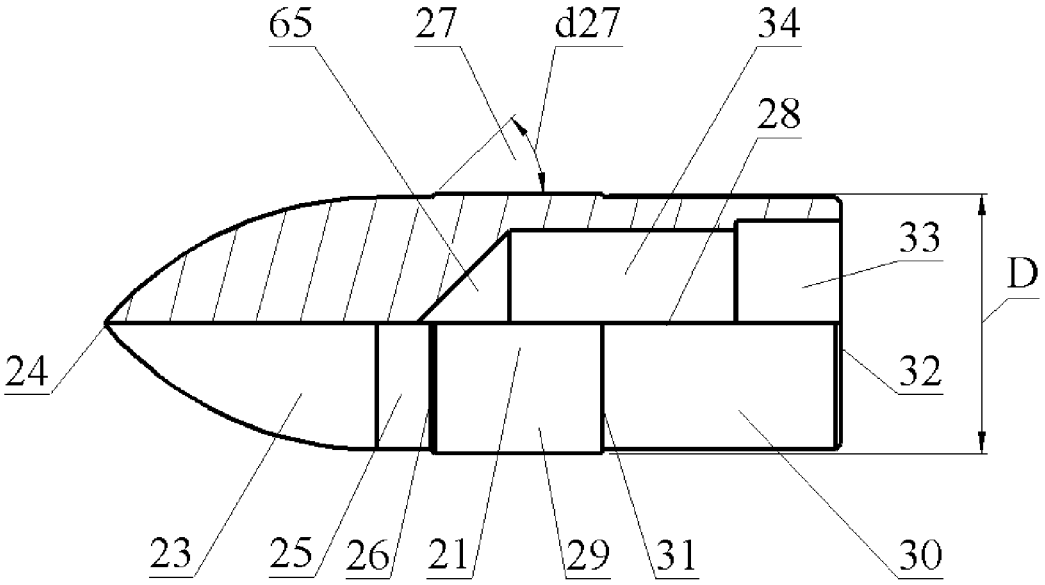
FIG. 36. Acute shell, hereafter—shell 21 (side view).

FIG. 36 shows side view of shell 21. The fore-part of the shell 21 is made as a lancet section 23 with an acute end 24 which passes into cylindrical part 25, which passes into an inclined surface 26. Inclined surface 26 is made at an acute angle 27 to the longitudinal axis 28 of the shell 21. An acute angle has measure d27 which is equal to 30°-45° to the longitudinal axis 28 of the shell 21; as a result, rifling of ammunition in the weapon occurs in less vulnerable state. The inclined surface 26 passes into the leading cylindrical part 29 passes into the rear cylindrical part 30 with smaller diameter. Between the leading cylindrical part 29 and the rear cylindrical part 30 the ledge 31 is made. Rear cylindrical part 30 ends with a chamfer 32.

The inlet interior cylindrical hole 33 is made in the shell 21 for training igniter block 22, which passes into middle cylindrical hole 34, which passes into a conical hole 65, wherein the volume of the middle cylindrical hole 34 and the conical hole 65 is selected so that the total mass of the shell 21 is equal to the weight of caseless ammunition 1 or 6 or 8 or 10 or 12 or 16 or 18 and the training igniter block 22 is installed in the inlet interior cylindrical hole 33. All elements of shell 21, their shapes and interactions are shown on FIG. 36.

Figure 37:
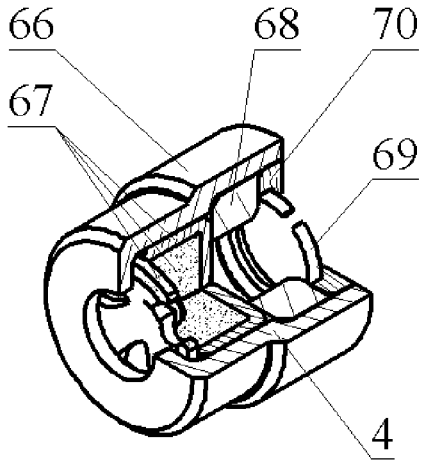
FIG. 37. Igniter block for mechanical extraction, hereafter—igniter block 4 (side view).

FIG. 37 shows side view of igniter block 4, which comprises body 66, primer of igniter block with an anvil 67, the interior washer 68, expanding ring 69 and the external washer-marker 70.

Figure 38:
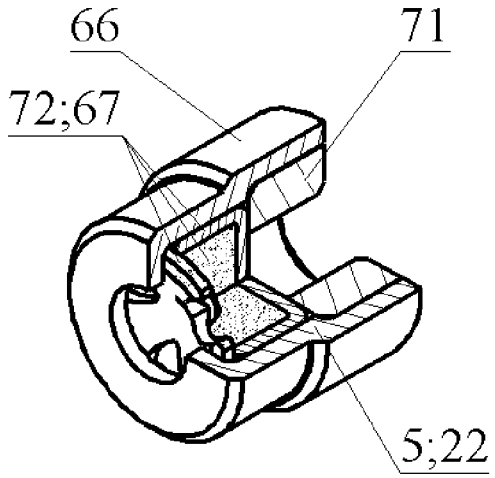
FIG. 38. Igniter block for magnetic extraction, hereafter—igniter block 5 and training igniter block 22 (side view).

FIG. 38 shows side view of igniter block 5 and training igniter block 22, which comprises body 66, primer of igniter block with an anvil 67, the magnetic extraction washer-marker 71.

Figure 39:
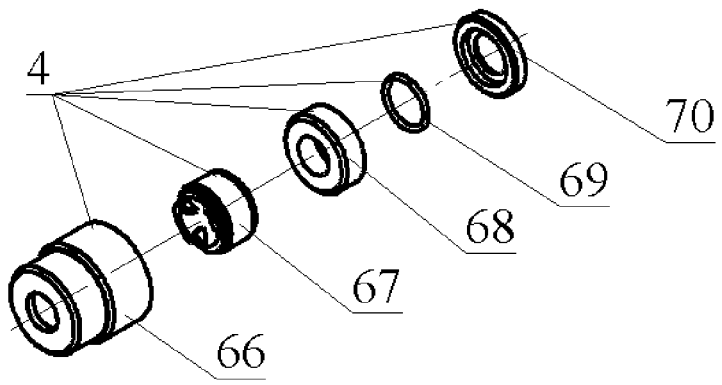
FIG. 39. Igniter block 4, detail design (side view).

FIG. 39 shows detail design of igniter block 4, which comprises body 66, primer of igniter block with an anvil 67, the interior washer 68, expanding ring 69 and the external washer-marker 70. The external washer-marker 70 is made in different colors in order to distinguish types of ammunition that is used.

Figure 40:
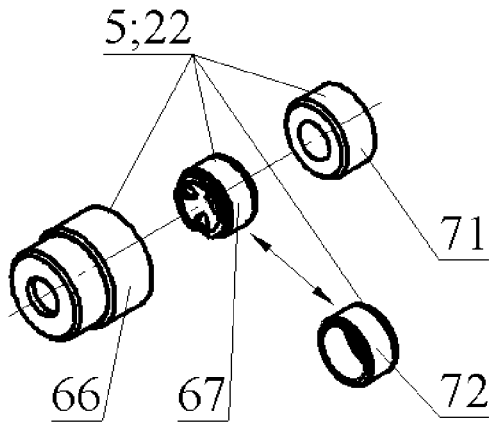
FIG. 40. Igniter block 5 and training igniter block 22, detail design (side view).

FIG. 40 shows detail design of igniter block 5 and training igniter block 22, which comprises body 66, primer of igniter block with an anvil of remington type 67 or sterile primer 72, the magnetic extraction washer-marker 71. The magnetic extraction washer-marker 71 is made in different colors which depended on type of ammunitions that are used. Training igniter block 22 has a sterile primer 72.

Figure 41:
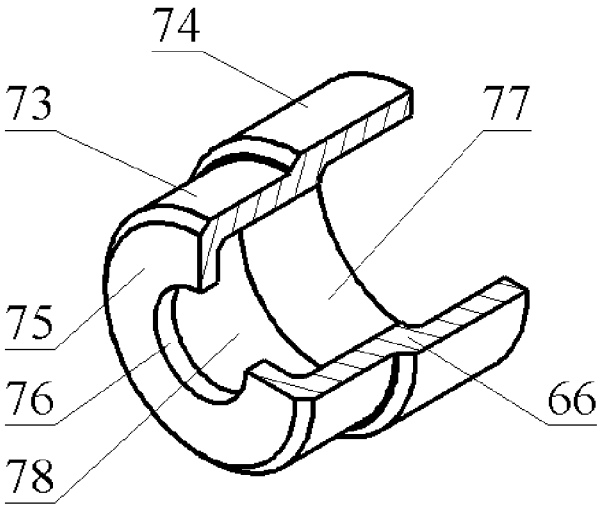
FIG. 41. Body of igniter block, hereafter—body 66 (side view).

FIG. 41 shows side view of body 66. Body 66 is made with small cylindrical section 73 which passes into a big cylindrical section 74. In the end face 75 of the small cylindrical section 73 central seed hole is made 76. In the end face of the big cylindrical section 74 a blind hole 77 is made, which passes into smaller blind hole 78. The blind hole 77 is used for interior washer 68, external washer-maker 70 or magnetic extraction washer-maker 71. Smaller blind hole 78 is used for primer of igniter block with anvil 67 or sterile capsule 72. All elements of body 66, their shapes and interactions are shown on FIG. 41.

Figure 42:
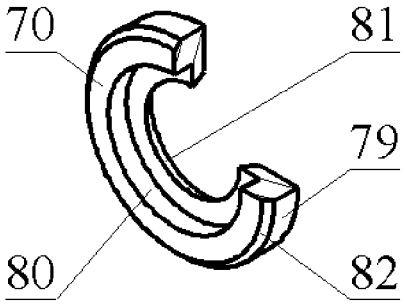
FIG. 42. External washer-marker 70 (side view).

FIG. 42 shows side view of external washer-maker 70. External washer-maker 70 which is made as a cylinder 79 with an interior cylindrical hole 80 for expanding ring 69. An interior cylindrical hole 80 passes into the small base of the conical section 81 with a smaller diameter. On a cylinder 79 external chamfer 82 is made from the side of the interior cylindrical hole 80. All elements of external washer-maker 70, their shapes and interactions are shown on FIG. 42.

Figure 43:
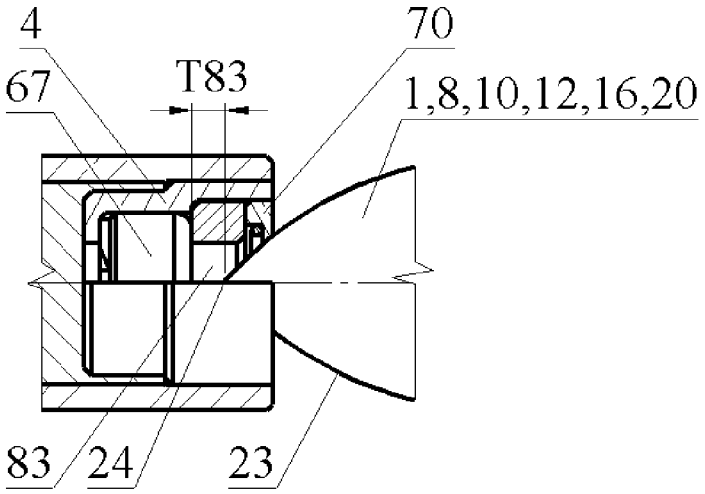
FIG. 43, FIG. 44. Protection of primer of igniter block with anvil 67 from ignition by acute end 24 of ammunition 1; 8; 10; 12; 16; 20 (side view).
Figure 44:
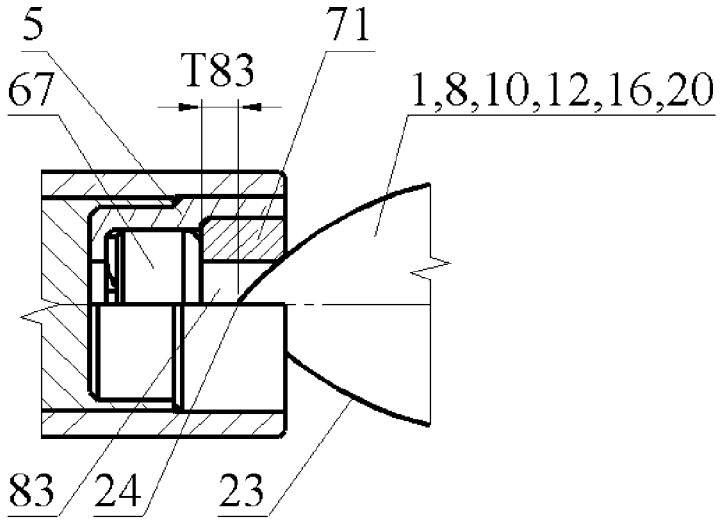

FIG. 43, 44 shows the protection of primer with an anvil 67 from ignition by acute end 24 of ammunition 1 or 8 or 10 or 12 or 16 or 20. Gap 83, which is located between the primer with an anvil 67 and the acute end 24 of the ammunition 1 or 8 or 10 or 12 or 16 or 20, doesn't allow to stab primer with an anvil 67 by acute end of ammunition 1 or 8 or 10 or 12 or 16 or 20. The thickness T83 of the gap 83 is equal to 0.05D, where D—outside diameter of the ammunition 1 or 6 or 8 or 10 or 12 or 16 or 18 or 20. Acute end 24 of ammunition 1 or 8 or 10 or 12 or 16 or 20 reduces the air resistance of the shell flight trajectory, which reduces the loss of initial shell velocity, and also increases the penetrating power in soft ballistic vests thanks to separation of cells of cloth, and in solid armored jackets thanks to concentration of voltage on considerably smaller area in an acute end 24.

Figure 45:
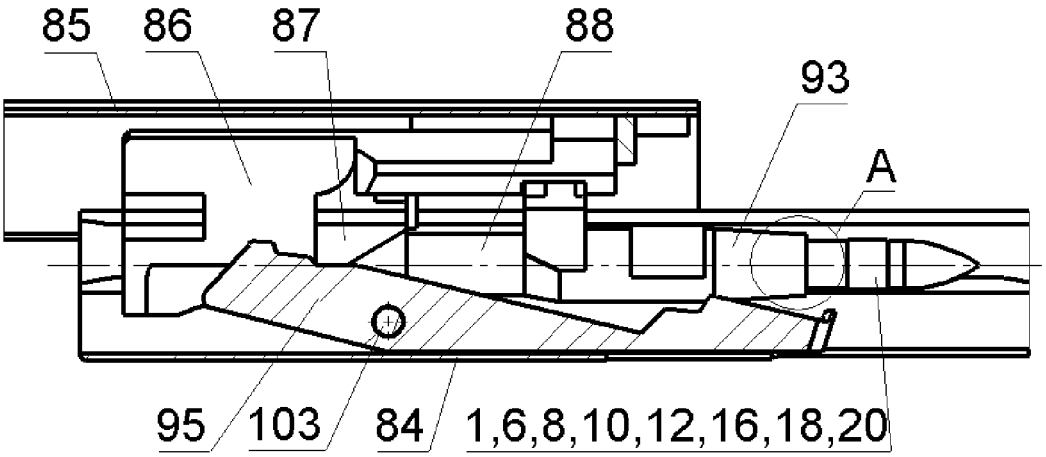
FIG. 45. Mechanism for extraction of caseless ammunition (side view).
Figure 46:
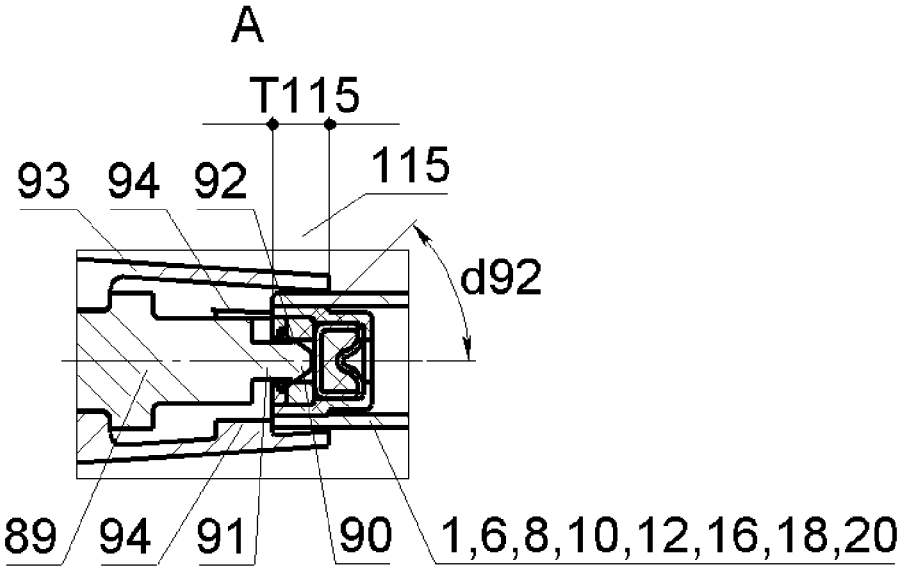
FIG. 46. Unit A of mechanism for extraction of caseless ammunition 1; 6; 8; 10; 12; 16; 18; 20 in weapon with open chamber, hereafter—mechanism (side view).

FIG. 45 shows side view of mechanism and FIG. 46—unit A of mechanism for extraction caseless ammunitions 1; 6; 8; 10; 12; 16; 18; 20 in weapon with open chamber. Mechanism comprises the receiver 84, the lid of the receiver 85, lock frame 86 with a front ledge 87, the bolt 88, the firing pin 89. On the front end of the firing pin 89 the conical part 90 is made, which passes into a cylindrical section of smaller diameter 91, wherein at the juncture of the conical section 90 and cylindrical section of smaller diameter 91 inclined ledge 92 is formed. The angle d92 of inclined ledge 92 about the axis of the firing pin 89 is 30-45 degrees what is optimum to ensure peeling force of ammunition 1 or 6 or 8 or 10 or 12 or 16 or 18 or 20 with riffling of the barrel. Mechanism also comprises conical bushing 93 which is made with interior ledges 94 of ammunition 1 or 6 or 8 or 10 or 12 or 16 or 18 or 20 and extractor 95.

Figure 47:
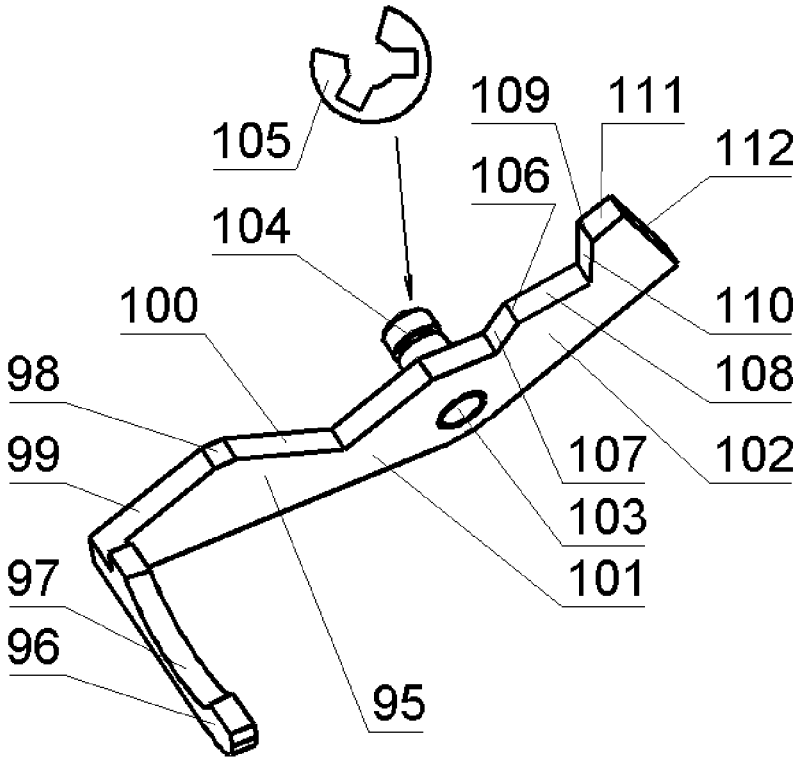
FIG. 47. Side view of extractor.

FIG. 47 shows side view of extractor 95. The extractor 95 is made with a ledge 96 with a semicircular hollow 97 which passes into an upper ledge 98 which has a front inclined area 99 and a rear inclined area 100. The upper ledge 98 passes into the fore-part 101 which passes into the rear part 102. A shaft 103 with a circular groove 104 which is placed at the juncture of the fore-part 101 and the rear part 102. Circular groove 104 is made for fixation of extractor 95 with contr-washers in receiver 84. The rear part 102 passes into the lower ledge 106 which has a front inclined area 107 and a rear horizontal area 108. The lower ledge 106 passes into the upper ledge 109 which has a front inclined area 110, an upper horizontal area 111 and a rear inclined area 112. All elements of extractor 95, their shapes and interactions are shown on FIG. 47.

Figure 48:
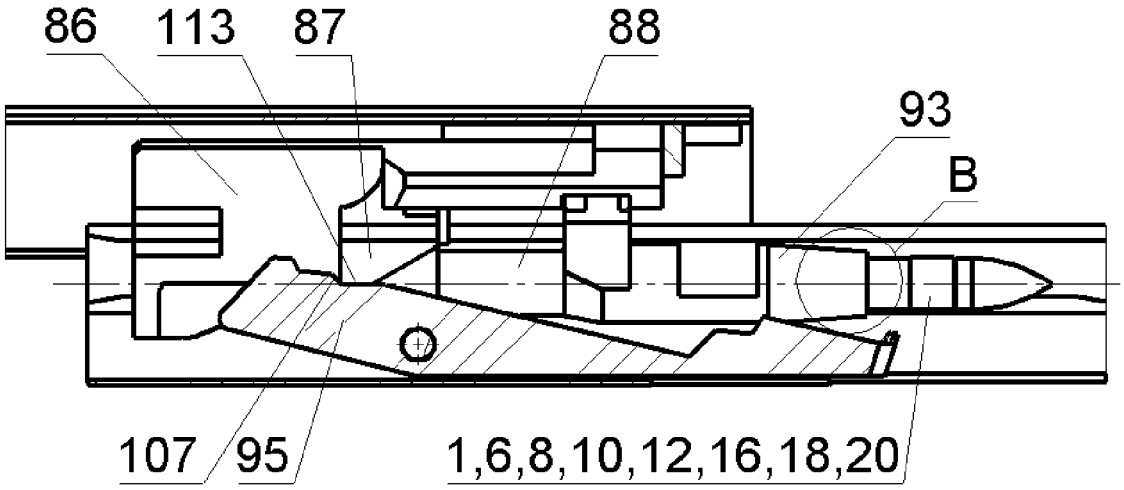
FIG. 48. Mechanism for extraction of caseless ammunition (side view).
Figure 49:
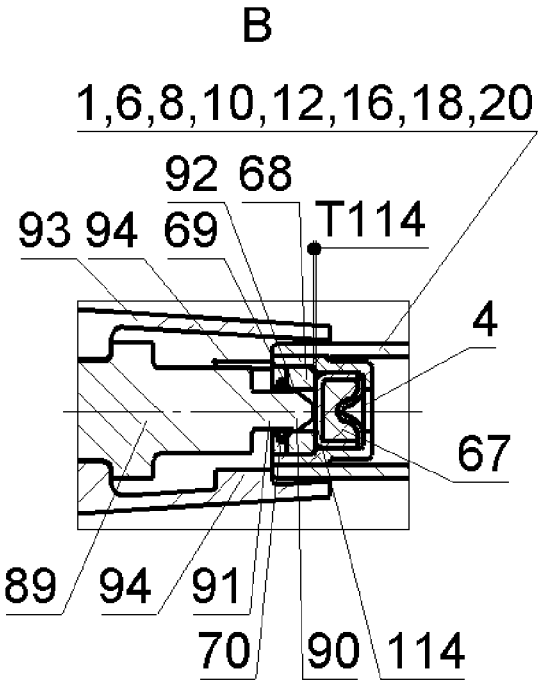
FIG. 49. Unit B for mechanical extraction on FIG. 48.
Figure 50:
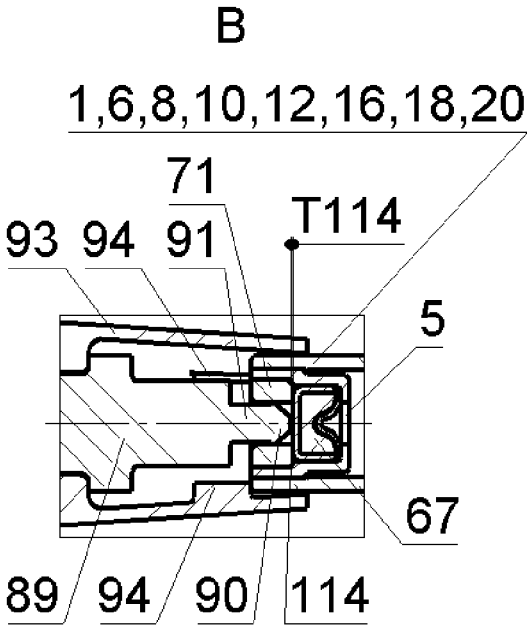
FIG. 50. Unit B for magnetic extraction on FIG. 48. Beginning of ammunition extraction 1;6;8;10;12;16;18;20.

FIG. 48 shows side view of mechanism and FIG. 49—unit B for mechanical extraction on FIG. 48 and FIG. 50—unit B for magnetic extraction on FIG. 48. Beginning of extraction of ammunition 1 or 6 or 8 or 10 or 12 or 16 or 18 or 20. Extraction of the ammunition 1 or 6 or 8 or 10 or 12 or 16 or 18 or 20 begins with approach of the lower part 113, a front ledge of lock frame 87, lock frame 86 to front inclined area 99 of extractor 95, wherein rear part of ammunition 1 or 6 or 8 or 10 or 12 or 16 or 18 or 20 enters into inclined ledge 92 on front ledge of lock frame 87 and bears against conical bushing 93, wherein rear par of ammunition 1 or 6 or 8 or 10 or 12 or 16 or 18 or 20 holds in cylindrical section with small diameter 91 by inclined ledge 92 of firing pin 89 with the help of expanding ring 69 which is arranged in external washer-maker 70 and interior washer 68 of igniter block 4 for mechanical extraction. There is magnetic extraction washer-maker 71, which magnetizes to firing pin 89, inside the igniter block 5, which is used for magnetic extraction of ammunition 1 or 6 or 8 or 10 or 12 or 16 or 18 or 20. Between the end face of conical section 90 of the firing pin 89 and a primer with an anvil 67 of igniter block 4,5 a gap 114 is made. The thickness T114 of the gap 114 is 0.03-0.05D, wherein D—outside diameter of the ammunition 1 or 6 or 8 or 10 or 12 or 16 or 18 or 20. The gap 114 between the end face of conical section 90 of the firing pin 89 and a primer with an anvil 67 of igniter block 4,5 doesn't allow to stab primer with anvil 67 by conical section 90 of firing pin 89, what provides reliability of loading and reloading cycle.

Figure 51:
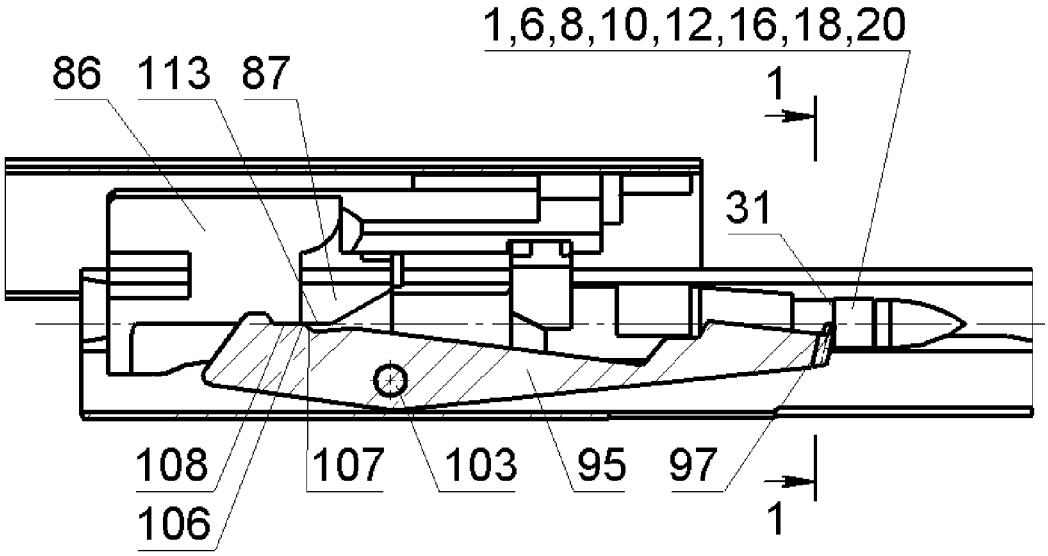
FIG. 51. Mechanism for extraction of caseless anmnition (side view).
Figure 52:
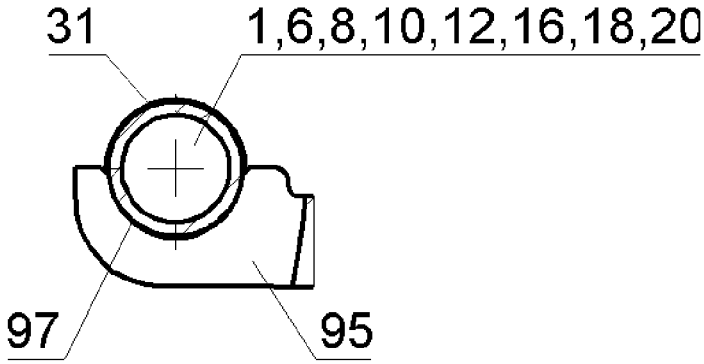
FIG. 52. A cross-section 1-1 on FIG. 51. The supply of extractor 95 for ammunition 1; 6; 8; 10; 12; 16; 18; 20 is shown.

FIG. 51 shows side view of mechanism and FIG. 52—cross-section 1-1 on FIG. 51. Supply of the extractor 95 under the ammunition 1 or 6 or 8 or 10 or 12 or 16 or 18 or 20. During the supply of the extractor 95 under ammunition 1 or 6 or 8 or 10 or 12 or 16 or 18 or 20 lower part 113 of front ledge 87 of lock frame 86 passes along the front inclined area 107 of the lower ledge 106 and comes to beginning of rear horizontal area 108 of lower ledge 106 of the extractor 95. Extractor 95 rotates on shaft 103 and semicircular hollow 97 capture the ledge 31 of ammunition 1 or 6 or 8 or 10 or 12 or 16 or 18 or 20.

Figure 53:
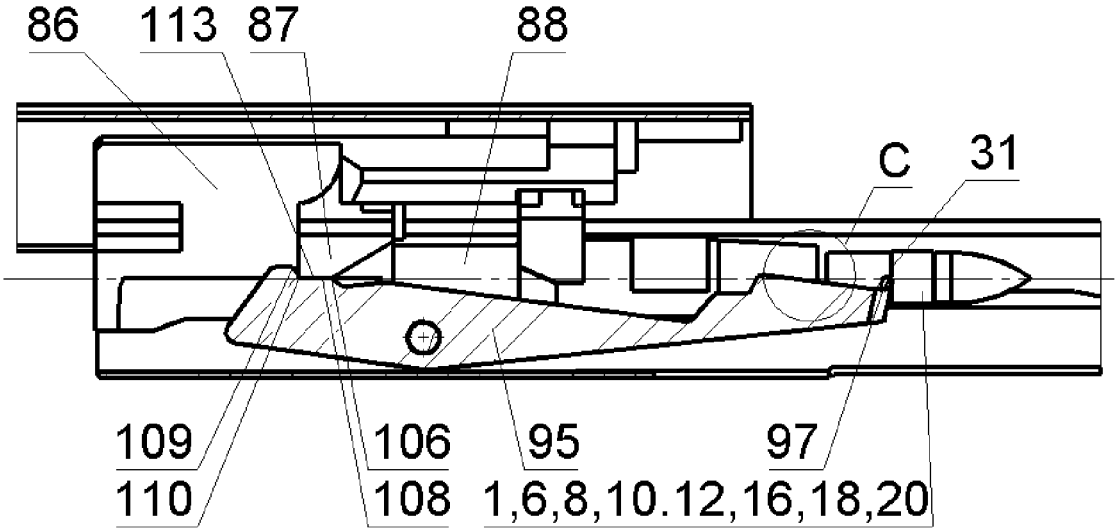
FIG. 53. Mechanism for extraction of caseless ammunition (side view).
Figure 54:
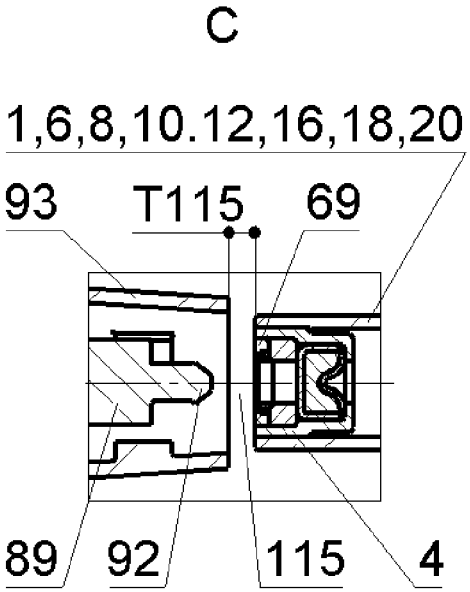
FIG. 54. Unit C on FIG. 53.
Figure 55:
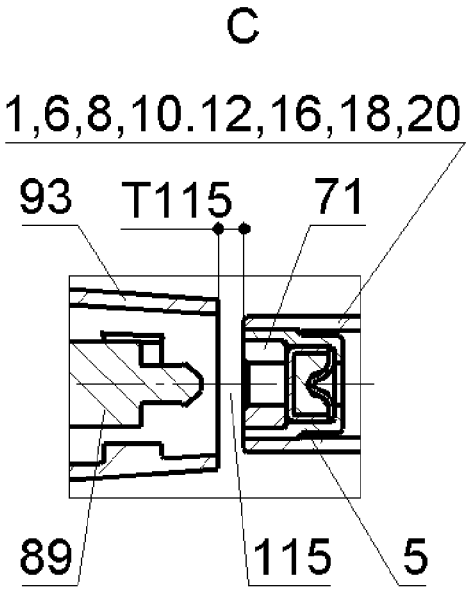
FIG. 55. Unit C on FIG. 53. The removal of trapped ammunition 1; 6; 8; 10; 12; 16; 18; 20 by means of extractor 95 from bolt 88 is shown.

FIG. 53 shows side view of mechanism and FIG. 54—unit C on FIG. 53, FIG. 55—unit C on FIG. 53. Removal of captured ammunition 1 or 6 or 8 or 10 or 12 or 16 or 18 or 20 from bolt 88 with the help of extractor 95 is shown. When the captured ammunition 1 or 6 or 8 or 10 or 12 or 16 or 18 or 20 is being removed, the lower part 113 of the front ledge 87 of the lock frame 86 passes along the rear horizontal platform 108 of the lower ledge 106 and bears against the beginning of the front inclined area 110 of the upper ledge 109 of the extractor 95. The semicircular hollow 97 holds the ammunition 1 or 6 or 8 or 10 or 12 or 16 or 18 or 20 in place behind the ledge 31. Meanwhile, for mechanical extraction, inclined ledge 92 of firing pin 89 opens expanding ring 69 and firing pin 89 comes out of engagement with igniter block 4 and conical bushing 93 on bolt 88 gets a gap 115 with the rear end of ammunition 1 or 6 or 8 or 10 or 12 or 16 or 18 or 20. During the magnetic extraction conical section 90 of firing pin 89 is beyond the magnetic extraction washer-marker of the igniter block 5, wherein the magnetized magnetic extraction washer-marker 71 torns off from the firing pin 89, and the conical bushing 93 on the bolt 88 gets a gap 115 with the rear end of the ammunition 1 or 6 or 8 or 10 or 12 or 16 or 18 or 20. The thickness T115 of the gap 115 is equal to 0.21), wherein D—outside diameter of the ammunition 1 or 6 or 8 or 10 or 12 or 16 or 18 or 20. The gap 115 between conical bushing 93 of bolt 88 and rear part of the ammunition 1 or 6 or 8 or 10 or 12 or 16 or 18 or 20 does not allow the rear end of the ammunition 1 or 6 or 8 or 10 or 12 or 16 or 18 or 20 to engage the conical bushing 93 during ejection beyond the weapon, what provides reliability of the loading cycle, reloading cycle.

Figure 56:
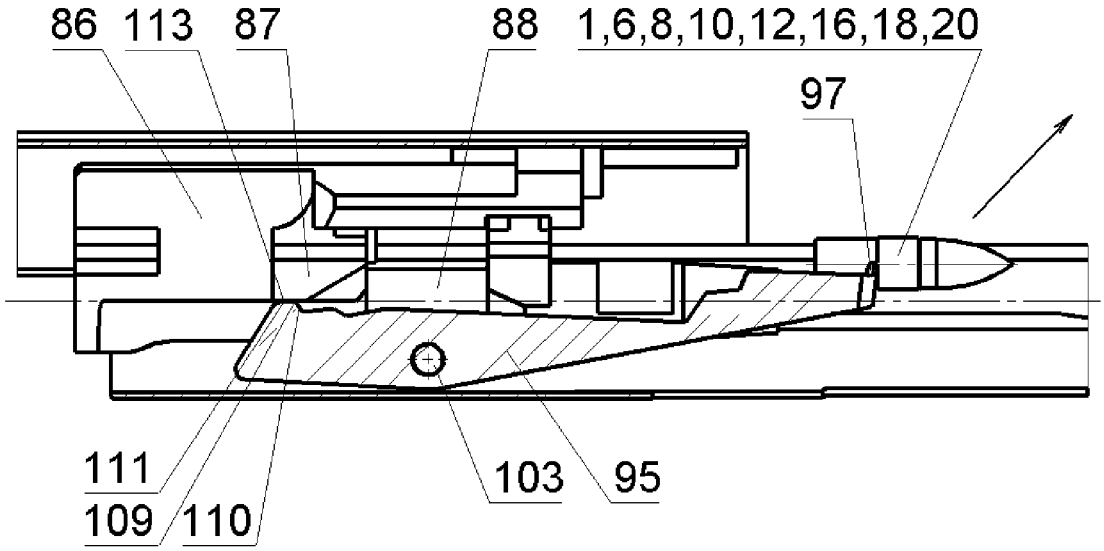
FIG. 56. Mechanism for extraction of caseless ammunition (side view). The ejection of ammunition 1; 6; 8; 10; 12; 16; 18; 20 by extractor 95 from weapon is shown.

FIG. 56 shows side view of mechanism. The ejection of ammunition 1 or 6 or 8 or 10 or 12 or 16 or 18 or 20 by extractor 95 from the weapon is shown. When the ammunition 1 or 6 or 8 or 10 or 12 or 16 or 18 or 20 is ejected by the extractor 95, the lower part 113 of the front ledge 87 of the lock frame 86 passes along the front inclined area 110 of the upper ledge 109, passes through the upper ledge 109, passes along the upper horizontal area 111 of the upper ledge 109, and stops at the end of it. During mentioned process the extractor 95 vigorously rotates on the shaft 103 and ejects the ammunition 1 or 6 or 8 or 10 or 12 or 16 or 18 or 20 from the weapon by semicircular hollow 97.

During the mechanism work in semi-automatic or automatic mode the lower part 113 of the front ledge 87 of the lock frame 86 only reaches the front inclined area 99 of the extractor 95, thanks to that the extractor 95 does not work during the shooting. Extractor 95 works in extraction of ammunition only during manual reloading what improve the reliability of weapon work in general and the extraction in particular. The reliability of extraction is achieved as expanding ring 69 or magnetic extraction washer-maker 71 take part in extraction once during the ejection of the training ammunition 20 or once during the ejection of the ammunition 1 or 6 or 8 or 10 or 12 or 18, in which the misfire has occurred, and are very simple in construction. The expanding ring 69 can make up to one million opening-closing cycles until failure in operation occurs, the magnetic extraction washer-marker 71 will have been demagnetized during 15 years no more than 5% of the initial magnetization.

In order to make a shot with the help of the claimed caseless ammunition, it is necessary to have a caseless weapon, which must have at least such mechanisms as: rifled barrel with cartridge chamber, barrel box, bolt with obturator, firing mechanism with striker, hammer in cocked position, firing spring, trigger, spring-loaded sear.

Shot is made with the help of claimed caseless ammunition in such way: ammunition is inserted into cartridge chamber of caseless weapon and is locked by bolt with obturator, where the problem of gas obturation in the bolt is solved. When the trigger is pressed, the spring-loaded sear comes out of engagement with the cocked position of the hammer and the hammer vigorously rotates under the action of the firing spring and strikes the striker. Striker fires primer of igniter block in caseless ammunition by its pan, propellant ignites, gases of high temperature and pressure are formed during the ignition of propellant and igniter block, they force shell to fly out of the barrel, rifling, getting axial rotation of the shell which is needed for stabilization of shell flight. There is combustible washer-marker in front of the primer of igniter block and when the washer is being burnt, the released gases pushes the standard primer of igniter block out after the shell. Depending on the purpose, changing the shell, it is possible to achieve a wide variety of tasks in shooting; claimed for invention ammunition can be armor-piercing, tracing, training, etc. If the igniter block is non-combustible, a mechanism of the ejecting of the igniter block is necessary in the weapon.

The invention claimed is:

1. A mechanism for extraction caseless ammunition comprises a receiver (84) interacting with a lid of the receiver (85) which is made with possibility to make in and out movement;

lock frame (86) which is made with possibility to make in and out movement and interacts with the lid of the receiver (85);

a bolt (88) is made in the lock frame (86), and installed with possibility to make in and out movement;

a conical bushing (93) is installed inside the bolt (88) through a firing pin (89); an extractor (95) which is made with possibility to rotate on a shaft (103) in the receiver (84), wherein lock frame (86) is made with a front ledge (87);

on a front end of the firing pin (89) a conical part (90) is made, which passes into a cylindrical section of smaller diameter (91), herewith at the juncture of the conical section (90) and cylindrical section of smaller diameter (91) inclined ledge (92) is formed;

conical bushing (93) is made with interior ledges (94); an extractor (95) is made with a ledge (96) with a semicircular hollow (97) which passes into an upper ledge (98) which has a front inclined area (99) and a rear inclined area (100) and the upper ledge (98) passes into a fore-part (101) which passes into a rear part (102);

a shaft (103) with a circular groove (104) which is placed on a contact point of the fore-part (101) and the rear part (102), herewith the rear part (102) passes into a lower ledge (106) which has a front inclined area (107) and a rear horizontal area (108) and the lower ledge (106) passes into a upper ledge (109) which has a front inclined area (110), an upper horizontal area (111) and a rear inclined area (112).

2. The mechanism for the extraction of caseless ammunition according to claim 1, wherein an angle (d92) of inclined ledge (92) about an axis of the firing pin (89) is 30-45 degrees.

3. The mechanism for the extraction of caseless ammunition according to claim 2, wherein a thickness (T114) of the gap (114) is 0.03-0.05D, wherein D is an outside diameter of the ammunition.

4. The mechanism for the extraction of caseless ammunition according to claim 1, wherein between an end face of conical section (90) of the firing pin (89) and a primer with an anvil (67) of igniter block (4,5) of the caseless ammunition a gap (114) is made.

5. The mechanism for the extraction of caseless ammunition according to claim 1, wherein the conical bushing (93) on the bolt (88) forms a gap (115) with a rear end of the ammunition.

6. The mechanism for the extraction of caseless ammunition according to claim 5, wherein a thickness (T115) of the gap (115) is equal to 0.2D, wherein D is an outside diameter of the ammunition.

7. The mechanism for the extraction of caseless ammunition according to claim 1, wherein the mechanism works only with hand reloading.

* * * * *